US008160282B2

(12) United States Patent
Christoph et al.

(10) Patent No.: US 8,160,282 B2
(45) Date of Patent: Apr. 17, 2012

(54) SOUND SYSTEM EQUALIZATION

(75) Inventors: Markus Christoph, Straubing (DE); Leander Scholz, Salching (DE)

(73) Assignee: Harman Becker Automotive Systems GmbH, Karlsbad (DE)

( * ) Notice: Subject to any disclaimer, the term of this patent is extended or adjusted under 35 U.S.C. 154(b) by 1355 days.

(21) Appl. No.: 11/697,119

(22) Filed: Apr. 5, 2007

(65) Prior Publication Data

US 2008/0049948 A1 Feb. 28, 2008

(30) Foreign Application Priority Data

Apr. 5, 2006 (EP) ..... 06007213

(51) Int. Cl.
*H04R 5/02* (2006.01)

(52) U.S. Cl. ..... 381/310

(58) Field of Classification Search ..... 381/103, 381/98, 1, 17–23, 99, 104, 61, 63, 300, 310, 381/86, 89, 111, 117, 26, 96
See application file for complete search history.

(56) References Cited

U.S. PATENT DOCUMENTS

| | | | | |
|---|---|---|---|---|
| 4,739,513 | A | 4/1988 | Kunugi et al. | |
| 5,173,944 | A * | 12/1992 | Begault | 381/17 |
| 5,581,621 | A | 12/1996 | Koyama et al. | |
| 5,581,622 | A | 12/1996 | Sakurai | |
| 5,910,990 | A | 6/1999 | Jang | |
| 5,999,630 | A * | 12/1999 | Iwamatsu | 381/17 |
| 7,519,188 | B2 * | 4/2009 | Berardi et al. | 381/104 |
| 2005/0063554 | A1 * | 3/2005 | Devantier et al. | 381/99 |

FOREIGN PATENT DOCUMENTS

| | | |
|---|---|---|
| JP | 2000261900 | 9/2000 |
| JP | 2000354300 | 12/2000 |
| JP | 2001025100 | 1/2001 |
| JP | 2002354599 | 12/2002 |
| JP | 2005027055 | 1/2005 |
| JP | 2005059688 | 3/2005 |
| JP | 2005223491 | 8/2005 |
| WO | 0182650 | 11/2001 |

OTHER PUBLICATIONS

Zwicker et al., "Psychoacoustics-Facts and Models," 2nd Edition, Springer Verlag, Berlin/Heidelberg/New York, 1999, pp. 149-164.

* cited by examiner

*Primary Examiner* — Davetta W Goins
*Assistant Examiner* — Lao Lun-See
(74) *Attorney, Agent, or Firm* — O'Shea Getz P.C.

(57) ABSTRACT

An automatic sound system equalizer adjusts a sound system to a target sound, where the sound system includes at least two groups of loudspeakers supplied with electrical sound signals to be converted into acoustical sound signals. The equalizer sequentially supplies each group with the respective electrical sound signal; sequentially assesses the deviation of the acoustical sound signal from the target sound for each group of loudspeakers, and adjusts at least two groups of loudspeakers to a relatively small, preferably minimum deviation from the target sound by equalizing the respective electrical sound signals supplied to the groups of loudspeakers.

40 Claims, 21 Drawing Sheets

SOUND SYSTEM EQUALIZATION

CLAIM OF PRIORITY

This patent application claims priority to European Patent Application serial number 06 007 213.9 filed on Apr. 5, 2006.

FIELD OF THE INVENTION

The present invention relates to automatically equalizing a sound system.

RELATED ART

Conventional practice has been to acoustically optimize dedicated systems such as motor vehicles by hand. Although there have been major efforts in the past to automate this manual process, these methods, for example the Cooper/Bauk method have, however, shown weaknesses in practice. In small, highly reflective areas, such as the interior of a car there were generally no improvements in the acoustics. In most cases, the results are even worse.

Up to now, major efforts were devoted to analysis and correction of these inadequacies. Techniques for equalization of acoustic poles and nulls (CAP method) occurring jointly at different listening locations are worthy of mention, or those intended to achieve equalization with the aid of a large number of sensors in the area with the assistance, for example of the Multiple Error Least Mean Square (MELMS) algorithm. Spatial filters or smoothing methods such as complex smoothing according to John N. Mourjopoulos, or else centroid methods have led only to a limited extent to the aim of achieving good acoustics in a poor acoustic environment. However, the fact that it is possible to achieve a good acoustic result even with simple techniques has been proven by the work by professional acousticians.

Actually, there is already one method, wave-field synthesis, which allows acoustics to be modeled in virtually any area. However, wave-field synthesis requires extensive resources such as computational power, memories, loudspeakers, amplifier channels, et cetera. This technique is thus not suitable at the moment for motor vehicle applications, for cost and feasibility reasons.

SUMMARY OF THE INVENTION

It is an object of the present invention to provide an automated technique for equalizing a sound system (e.g., in a passenger compartment of a motor vehicle) which replaces the previously used, complex process of manual equalizing by experienced acousticians and reliably provides frequency responses of the level and of the phase of the reproduced sound signal at the predetermined seating positions in the vehicle interior which, as most accurately, match the profile of predetermined target functions. The sound system includes at least two groups of loudspeakers supplied with electrical sound signals to be converted into acoustical sound signals.

The technique for automatically adjusting a sound system to a target sound comprises individually supplying each group with the respective electrical sound signal and individually assessing the deviation of the acoustical sound signal from the target sound for each group of loudspeakers in at least one listening position. The technique then adjusts at least two groups of loudspeakers to a minimum deviation from the target sound by equalizing the respective electrical sound signals supplied to the groups of loudspeakers. The assessment step may include receiving in the listening position the acoustical sound signal from a certain group of loudspeakers, where the total assessment over all listening positions is derived from the assessments at the at least one listening position weighted with a location specific factor, and where each position specific factor comprises an amplitude specific factor and a phase specific factor.

An automatic, for example iterative technique for equalizing the magnitude and phase of the transfer function of all of the individual loudspeakers of a sound system, e.g., in a motor vehicle, is disclosed which automatically determines the necessary parameters for equalizing. Advantageously, the automatic sound system equalization of the present invention provides appropriate filtering in a digital signal processing system.

The automatic matching of the transfer function of the sound system to a predetermined target function may also be in cases where the number and frequency range of the loudspeakers which are used for the sound system may be variable.

Further advantages may result if an automatic algorithm approaches the predetermined target function, by considering each individual loudspeaker of a pair of loudspeakers which form a stereo pair in the sound system individually, and by optimizing each individual loudspeaker with regard to equalizing its transfer function.

Even further advantages may be obtained if not only the equalizing of the loudspeakers in the sound system is carried out by the automatically, but also the crossover filters for loudspeakers in the sound system are modeled and implemented in a digital signal processing system.

Even further advantages may result if the automatic sound equalization optimizes the equalizing not only for one seat position (e.g., that of the driver) but allows all of the seat positions in a motor vehicle, and thus listener positions, to be included in the equalizing process with selectable weighting.

DESCRIPTION OF THE DRAWINGS

The invention can be better understood with reference to the following drawings and description. The components in the figures are not necessarily to scale, instead emphasis being placed upon illustrating the principles of the invention. Moreover, in the figures, like reference numerals designate corresponding parts. In the drawings.

DETAILED DESCRIPTION

Figure 1:
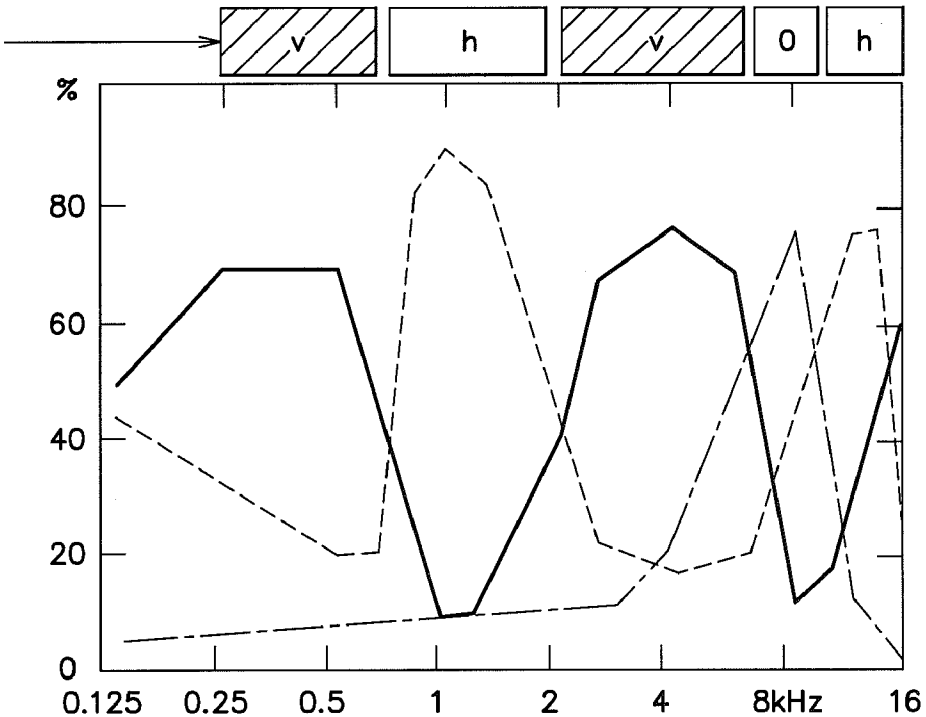
FIG. 1 illustrates the Blauert direction-determining bands.
Figure 1:
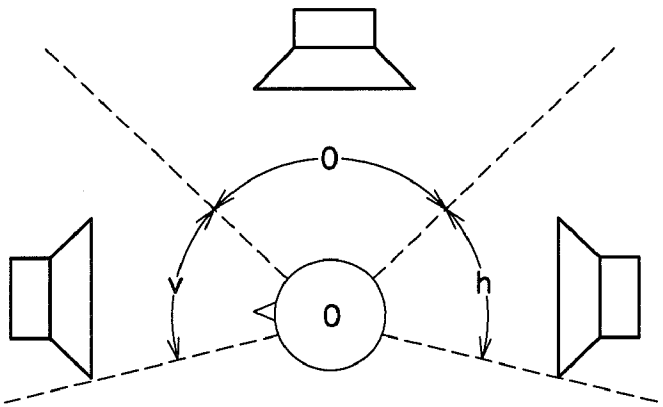

The following example describes the procedure and the investigations in order to create a signal processing technique which is also referred to in the following text as AutoEQ, for automatically adjusting, for example, of equalizing filters. Two procedures are investigated that are disclosed in detail further below, together with a sequential technique and a technique for taking account of the maximum interval between a measured level profile and a predetermined target function. The results obtained are used to derive a technique, which is then used for automatic equalizing, that is to say without any manual influence on the parameters involved. The major tonal sensitivities to be taken into account in this case which comprise psycho-acoustic parameters of human perception of sounds, are the location capability, the tonality and the staging.

In this case, the location capability, which is also referred to as localization, denotes the perceived location of a hearing event, as a result, for example from the superimposition of stereo signals. The tonality results from the time arrangement and the harmony of sounds and the ratio of the background noise to the useful signal that is presented, for example, stereophonic audio signals. Staging is used to refer to the effect of perception of the point of origin of a complex hearing event that is composed of individual hearing events, such as that which results from an orchestra, in which case individual hearing events, for example instruments, always have their own location capability.

In principle, the location capability of phantom sound sources which are produced by stereophonic audio signals depends on a plurality of parameters, the delay-time difference of arriving sound signals, the level difference of arriving sound signals, the inter-aural level difference of an arriving sound between the right and left ear (inter-aural intensity difference IID), the inter-aural delay time difference of an arriving sound between the right and left ear (inter-aural time difference ITD), the head related transfer function HRTF, and on specific frequency bands in which levels have been raised, with the spatial directional localization in terms of front, above and to the rear depending solely on the level of the sound in these frequency bands without their being any delay-time difference or level difference in the sound signals at the same time in the latter case.

The major parameters for spatial-acoustic perception are the inter-aural time difference ITD, the inter-aural intensity difference IID and the head related transfer function HRTF. The ITD results from delay-time differences between the right and left ear in response to a sound signal arriving from the side, and may assume orders of magnitude of up to 0.7 milliseconds. If the speed of sound is 343 m/s, this corresponds to a difference of about 24 centimeters in the path length of an acoustic signal, and thus to the anatomical characteristics of a human listener. In this case, the hearing evaluates the psycho-acoustic effect of the law of arrival of the first wavefront. At the same time it is evident for a sound signal which arrives at the head at the side, that the sound pressure that is applied to the ear which is spatially further away is less (IID) owing to sound attenuation.

It is also known that the auricle of the human ear is shaped such that it represents a transfer function for received audio signals into the auditory system. The auricles thus have a characteristic frequency response and phase response for a given sound signal incidence angle. This characteristic transfer function is convolved with the sound which is entering the auditory system and contributes considerably to the spatial hearing capability. In addition, a sound which reaches the human ear is also changed by further influences. These changes are caused by the environment of the ear, that is to say the anatomy of the body.

The sound which reaches the human ear has already been changed on its path to the ear not only by the general spatial acoustics but also by shadowing of the head or reflections on the shoulders or on the body. The characteristic transfer function which takes account of all of these influences is in this case referred to as the head related transfer function (HRTF) and describes the frequency dependency of the sound transmission. HRTFs thus describe the physical features which the auditory system uses for localization and perception of acoustic sound sources. In this case, there is also a relationship with the horizontal and vertical angles of the incident sound.

In the simplest embodiment of a stereo presentation, correlated signals are offered via two physically separated loudspeakers, forming a so-called phantom sound source between the two loudspeakers. The expression phantom sound source is used because a hearing event is perceived where there are no loudspeakers as a result of the superimposition and addition of two or more sound signals produced by different loudspeakers. When two correlated signals at the same level are reproduced by two loudspeakers in a stereo arrangement, then the sound source (phantom sound source) is located as being on the loudspeaker base, that is to say in the center. This also applies in principle to the presentation of audio signals via sound systems using a large number of loudspeakers, as are normally used nowadays both in domestic stereo systems and in motor vehicle applications.

A phantom sound source can move between the loudspeakers as a result of delay-time and/or level differences between the two loudspeaker signals. Level differences of between 15 and 20 dB and delay-time differences of between 0.7 and 1 ms, up to a maximum of 2 ms are required to shift the phantom sound source to the extreme on one side, depending on the signal.

The asymmetric seat position (driver, front-seat passenger, front and rear row or rows of seats) for loudspeaker configuration in a vehicle leads to sounds arriving neither with the same phase nor with the same delay time with respect to the position of a single listener. This primarily changes the spatial sensitivity, although the tonality and localization are also adversely affected. The staging propagates on both sides unequally in front of the listener. Although delay-time correction with respect to an individual listener position would be possible, this is not desirable since this would automatically lead to matching specifically for one individual seat, with a disadvantageous effect on the remaining seats in the motor vehicle.

As already mentioned above, the spatial directional localization also depends on the level of the sound in specific frequency bands, without there being any delay-time difference or level difference between the sound signals at the same time (for example a mono signal arriving from the front). By way of example, investigations have in this case shown that, for a mid-frequency of 1 kHz and above 10 kHz (narrowband test signal), test subjects locate a signal that is offered as being behind them, while an identical sound event with a mid-frequency of 8 kHz is localized as being above. If a signal contains frequencies of around 400 Hz or 4 kHz, then this enhances the impression that the sound has come from in front, and thus the presence of a signal. These different frequency ranges, which are shown in FIG. 1, are referred to as Blauert direction-determining bands (see Jens Blauert, Räumliches Hören, [Spatial listening] S. Hirzel Verlag, Stuttgart, 1974) and the knowledge of the effect of these various frequency bands on the spatial localization of a complex sound signal can be helpful for filtering or equalizing complex sound signals to produce desired hearing sensitivities, since it is possible to determine in advance those frequency ranges in which, by way of example, filtering and equalizing associated with it will best achieve the greatest possible desired effect.

The influences of the various parameters, such as the level in different frequency ranges, the level differences between loudspeakers and loudspeaker groups, phase differences between the signals on arrival at the right and left ear, have been investigated in the following text with respect to the effect on the localization capability, tonality and staging, in order then to use the knowledge obtained to derive a technique for automatic equalizing of sound systems, for example in motor vehicles.

During the investigations, it was found that the production of stable tonal properties and good location (localization capability) can essentially be achieved only by influencing the phase angle of the arriving sound signals and not by equalizing of the amplitudes. In this case, the matching process was carried out taking into account the Blauert direction-determining bands mentioned above and taking account of individual loudspeaker groups in the sound system. According to an aspect of the invention, the procedure is in this case similar to the known procedure by acousticians for adjustment of an optimum hearing environment. This procedure is characterized in that groups of mutually associated loudspeakers are processed successively to determine their contribution to a desired required frequency response (sequential technique).

The required frequency response, which is used as a reference in this case and is also referred to in the following text as the target function of the level and phase profile over the frequency, is determined during hearing trials. In this case, a sound system with all of the individual loudspeakers is simulated in laboratory conditions (low-echo room) as in the situation, for example when producing sound in passenger compartments in motor vehicles. A significant group of trial subjects is in this case offered various sound signals that comprise music of different styles, such as classical, rock, pop, et cetera. The trial subjects reproduce their subjective hearing impression (e.g., tonality, localization capability, presence, staging, etc.) for different settings of the parameters of the sound system, such as cut-off frequencies of the crossover filters of the loudspeakers, the level profile in the various spectral ranges and thus loudspeaker groups (e.g., woofers, medium-tone speakers, tweeters) or the phase angle of the sound signals arriving at the location of the test subjects. This results in an idealized target function being determined that is used as a reference for the equalizing of sound systems in motor vehicles, and which is intended to be achieved as exactly as possible by these sound systems in actual environmental conditions. In this case, it should be noted that complex sound systems now allow hearing environments to be created that have desired individual features and which thus, for example, can be associated by trained listeners with specific manufacturers of sound systems and/or, for example, loudspeakers.

The loudspeaker groups mentioned above and mentioned for the equalizing of a sound system to achieve an optimum listening environment in this case, by way of example, comprise the groups of sub-woofers, woofers, rear, side, front and center, and the phases of these loudspeaker groups, for example front left and front right, are matched by the equalizing process such that signals from the respective loudspeaker groups arrive as far as possible in the same phase as the left and right ear, thus making it possible to achieve the best-possible location capability effect.

Typically, the process of adjustment of the tonality is started once the phases of the individual, independent loudspeaker groups have been matched. For this purpose, the individual loudspeaker groups are first equalized separately with respect to the level, corresponding to the sum target function. This results in all of the medium-high-tone loudspeaker pairs sounding similar. Excessive levels in an individual loudspeaker group and/or in an individual spectral range would reduce the so-called sweet spot, that is to say that spatial area in which the listening experience is at its best in terms of the stated parameters, since the localization is fixed on that loudspeaker group which actually produces the highest level for the signal being reproduced at that time.

Once this process of equalizing the individual loudspeaker pairs has been carried out, the levels of these individual groups are then matched to one another. This is done by changing the maxima of the measured sound levels of the individual broadband loudspeaker groups to a common level value. This can be done by reducing the levels of specific loudspeaker groups, increasing the levels of specific loudspeaker groups or by a mixture of these techniques. In each case, care is taken to ensure that none of the loudspeaker groups is overdriven by raising the level, which may result in undesirable effects, such as non-linear distortion, while excessive reduction in the level would no longer ensure adequate transmission of all of the frequency components associated with this loudspeaker group.

The levels for matching of the bass channels, which are likewise predistorted in the previous equalizing process, are in this case determined using a somewhat modified technique, to be precise by relating the sum function of all of the loudspeaker groups for the medium-tone range to a target function. In the broadband case, the levels of the bass channels are dealt with differently during the matching process.

In a further step, the level, averaged over the frequency range of the respective loudspeaker group, of this loudspeaker group can also be used as a measure for the extent to which the individual loudspeaker groups must be matched to one another, that is to say must be changed to a common, medium level value. In this case, care is taken, as mentioned above, to ensure that this matching process does not lead to undesirable effects such as excessively high or excessively low sound levels from the individual loudspeaker groups.

Furthermore, sound levels can be assessed before the matching process, using the so-called A-assessed level. As can be seen from FIG. 2, the sensitivity of the human ear depends on the frequency. Tones at very low frequencies and tones at very high frequencies are in this case perceived as being quieter than medium-frequency tones.

The expressions volume and loudness that are used in this context relate to the same sensitivity variable and differ only in their units. They take account of the frequency-dependent sensitivity of the human ear. The psycho-acoustic variable loudness indicates how loud a sound event at a specific level, with a specific spectral composition and for a specific duration is perceived to be subjectively. The loudness is doubled when a sound is perceived as being twice as loud and thus allows comparison of different sound events with respect to the perceived volume. The unit for assessment and measurement of loudness is in this case the sone. A sone is defined as the perceived volume of a sound event of 40 phons, that is to say the perceived volume of a sound event that is perceived as being equally loud to a sinusoidal tone at the frequency of 1 kHz with a sound pressure level of 40 dB.

At medium and high volume levels, an increase in the volume by 10 phon leads to the loudness being doubled. At low volume levels, even minor volume increases lead to the perceived loudness being doubled. The volume as perceived by people in this case depends on the sound pressure level, the frequency spectrum and the behavior of the sound over time and is likewise used for modeling of masking effects. By way of example, standardized measurement techniques for loudness measurement also exist according to DIN 45631 and ISO 532 B.

Figure 2:
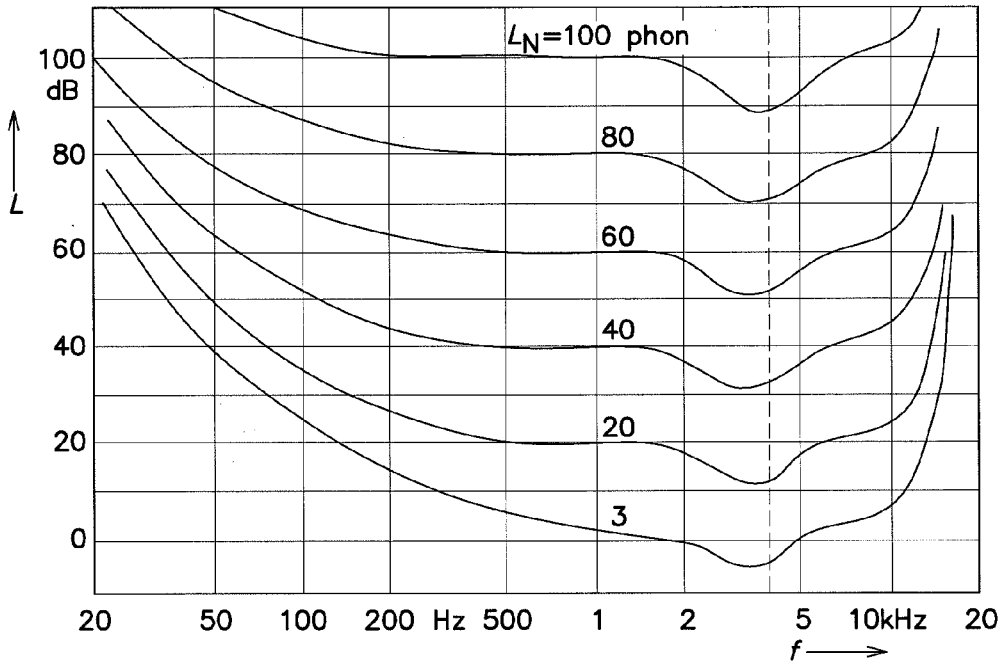
FIG. 2 illustrates curves of equal volume for the planar sound field.

FIG. 2 illustrates curves of equal volume. In this case the frequency is plotted logarithmically on the abscissa, and the level L of the offered narrowband sounds is plotted along the ordinate. For various level volumes $L_N$ whose unit is the phon, and associated loudnesses N whose unit is the sone, it can be seen that tones or noises with the same sound pressure level L are perceived as being quieter at low and high frequencies than at medium frequencies. The illustration in FIG. 2 has been taken from E. Zwicker and R. Feldtkeller, "*Das Ohr als Nachrichtenempfänger*" [The ear as an information receiver], S. Hirzel Verlag, Stuttgart, 1967.

This knowledge about the frequency dependency of volume sensitivity can be taken into account according to an aspect of the present invention by subjecting the frequencies contained in the sound to the A-assessment as mentioned above, before matching of the various loudspeaker groups. The A-assessment is a frequency-dependent correction of measured sound levels, by which the physiological hearing capability of the human ear is simulated, with the level values that result from this assessment being stated using dB(A) as the units. As generally known, highs and lows are reduced and medium-levels are (slightly) increased by the A-assessment.

A considerably different matching process is obtained, however, by further subdividing the frequency range into sub-groups rather than making use of the relatively coarse subdivision of the offered frequency band, as is initially carried out by means of the individual loudspeaker groups. This prevents any level peaks in closely bounded frequency ranges in a loudspeaker group resulting in a corresponding reduction of all of the frequency ranges represented by this loudspeaker group. This subdivision can, in this case, be carried out in fractions of thirds for example, or in regions which are oriented to the characteristics of the human hearing. This subdivision will be described in more detail further below.

Since the addition of the level profiles of the individual, equalized frequency ranges or loudspeaker groups does not necessarily correspond to the profile of the desired required frequency response, the sum function itself which is obtained from the addition of the individual, equalized ranges and groups is equalized in a further process step. According to an aspect of the invention, the procedure involves adjustment of an optimum hearing environment including the sequential processing of loudspeaker groups.

During this process, the group with the greatest influence on the profile of the sum level is first of all changed such that this results in a profile that is as close as possible to the required frequency response. This change to the loudspeaker group with the greatest influence is carried out within previously defined limits, which once again ensure that none of the loudspeaker groups is overdriven by raising the level, which may result in undesirable effects such as non-linear distortion, while excessively reducing the level may mean that adequate transmission of all frequency components associated with this loudspeaker group was no longer ensured.

If the aim of approximating the profile of the required frequency response as exactly as possible with the loudspeaker group which makes the greatest contribution to the change in the sum level is not achieved in the frequency range under consideration in this case, that group which makes the next greater contribution to changing the sum level is then varied. According to an aspect of the invention, this procedure is continued until either the required frequency response is adequately approximated, or the predetermined limits, as defined in advance, for the permissible level change in the corresponding group are reached.

The investigations carried out have also shown that staging and spatial sensitivity can be influenced by the change in the sequence of processing of the groups, with desirably good staging being achieved in particular when the volumes of the various loudspeaker groups are changed with respect to one another. If, by way of example, front-seat passengers were to be given the hearing impression that the staging is perceived further in front, the rear and/or the side loudspeakers would have to be reduced and/or the front loudspeakers or the center loudspeaker would have to have their or its levels raised.

If, in contrast, the perceived location of the staging is initially too far upwards or downwards, or else too far forwards or backwards, the desired effect can be achieved, that is to say the perceived location of the staging can be optimized as desired, by appropriate moderate level changes in the area of the Blauert direction-determining bands (see FIG. 1). However, it is obvious that even in the case of moderate level changes in the area of the Blauert direction-determining bands, or if individual loudspeaker groups are raised or lowered to optimize the staging, a subsequent change in the sum level that has already been matched to the required frequency response and thus a renewed, possibly undesirable, discrepancy from the required frequency response, can result.

In order to keep this undesirable effect, the subsequent changing of the sum level which has already been matched to the required frequency response, as a result of the optimization of the staging as small as possible, the sequential processing is defined in advance in a specific manner, according to the invention. In this case, the technique according to an aspect of the invention comprises definition of the sequence of processing of the individual loudspeaker groups for adjustment of the equalizing, in advance, in such a way that this empirically ensures that the discrepancy from the approximation that has already been achieved to the required frequency response is minimized.

If, by way of example, one wished to move the perceived location of the staging further forwards, which is normally a situation that occurs frequently, it is recommended that the equalizing be carried out in the following sequence of loudspeaker groups: sub-woofer, woofer, rear, side, center and front. Variations in this fixed predetermined sequence can in this case be defined depending on the situation with regard to the current acoustic environment and the preference for a specific acoustic configuration. For example, from experience, it is possible in this case to interchange the rear and side as well as the center and front loudspeakers in the sequence with the desired staging still being produced in this case as well, but allowing variations in the overall impression of the acoustic environment. This allows good staging to be achieved by skillful choice, defined in advance, of the sequence of processing of the loudspeaker groups during the procedure per se, without excessively changing the sum level that has already been matched to the required frequency response.

In general, the aim is to carry out an equalizing technique that is as independent as possible of position, for acoustic presentation in motor vehicles. This means that the aim of the equalizing technique should not only result in a sweet spot as such but should also cover the region of optimum presentation, covering as large a spatial area as possible, while providing spatial areas of optimum presentation that are as large as possible at the respective positions of the driver and front-seat passenger as well as in the rear row or rows of seats. If one observes the manual work by acousticians with the same aim in the measurement and equalizing of sound systems for passenger compartments in motor vehicles, then it is evident that these acousticians set the filters for equalizing of each loudspeaker group to be left/right-balanced. This is understandable, because both the arrangement of the loudspeakers of a sound system per se and the interior of the passenger compartment of a motor vehicle, with the exception of the steering wheel and dashboard, are normally designed to be strictly left/right symmetrical. This procedure is also adopted in the technique according to an aspect of the invention for automatic equalizing.

To determine the results achieved by the respective equalizing technique by recording of the impulse responses of the regulated sound system, two B & K (Brüel & Kjaer, Denmark) ½" microphones without any separating disc and separated by 150 mm, were introduced, during the course of the investigations, at the four seat positions for the driver, front-seat passenger, rear left and rear right, which corresponds to the normal measurement method for investigation of the transfer functions in sound systems.

A further aspect of the optimization of the acoustic presentation via a sound system is the setting of the crossover filters, also referred to as frequency filters, for the individual loudspeakers. In principle, these crossover filters must be adjusted as a first step before carrying out any equalizing technique on the entire sound system. During the course of the investigations carried out, it was in this case found that it was relatively complicated to develop a suitable technique with acceptable computation complexity for automatic adjustment of the crossover filters and, initially, these crossover filters were therefore not adjusted automatically during the course of the further investigations so that, initially, they were adjusted manually (a technique for automatic adjustment of crossover filters is described further below). Manual adjustment such as this can be carried out quickly and effectively if, as in the present case, the physical data for the loudspeakers and their installation state are known. FIR filters or IIR filters can also be used as an embodiment for the crossover filters.

FIR filters are characterized in that they have an extremely linear frequency response in the transmission range, a very high cut-off attenuation, linear phase and constant group delay time, have a finite impulse response and operate in discrete time steps, which are normally governed by the sampling frequency of an analogue signal. An Nth order FIR filter is in this case described by the following differential equation:

$$y(n) = b_0 * x(n) + B_1 * x(n-1) + b_2 * x(n-2) + \ldots + b_N * x(n-N)$$

$$= \sum_{i=0}^{N} bi * x[n-i]$$

where y(n) is the initial value of the time n and is calculated from the sum, weighted with the filter coefficients $b_i$, of the N most recently sampled input values x(n-N) to x(n). In this case, the desired transfer function and thus the filtering of the signal are achieved by the definition of the filter coefficients $b_i$.

In contrast to FIR filters, IIR filters also use already calculated initial values in the calculation (recursive filters) and they are characterized in that they have an infinite impulse response, no initial oscillations, no level drop and a very high cut-off attenuation. The disadvantage in comparison to FIR filters is that IIR filters do not have a linear phase response, as is often highly desirable in acoustic applications. Since the calculated values in the case of IIR filters become very small after a finite time, however, the calculation can in practice be terminated after a finite number of sample values n, and the computation power complexity is considerably less than that required for FIR filters. The calculation rule for an IIR filter is:

$$y(n) = \sum_{i=0}^{N} b_i * x(n-i) - \sum_{i=0}^{N} a_i * y(n-i)$$

where y(n) is the initial value of the time n and is calculated from the sum, weighted with the filter coefficients $b_i$, of the sampled input values x(n) added to the sum, weighted with the filter coefficients $a_i$ of the initial values y(n). In this case, the desired transfer function is once again achieved by the definition of the filter coefficients $a_i$ and $b_i$.

In contrast to FIR filters, IIR filters may in this case be unstable, but have a higher selectivity for the same implementation complexity. In practice, the filter chosen is that which best satisfies the required conditions taking into account the requirements and computation complexity associated with them.

In the present case, it is thus preferred that crossover filters in the form of IIR filters be used. The use of FIR filters is advantageous because of the linear profile of the phase in the case of FIR filters, but would lead to an undesirably high level of computation complexity during use owing to the low filter cut-off frequencies required. IIR filters were thus used as the basis for the crossover filters in the following text, in which case these crossover filters are adjusted before carrying out the automatic equalizing process according to an aspect of the invention (AutoEQ) with their parameters first being transferred to the subsequent AutoEQ routine so that the phase distortion in the transmitted signals caused by these IIR filters can be taken into account in the calculation of the equalizing filters for phase matching, as described further above, for the location capability, and, if necessary, can be compensated for appropriately.

The channel gains of the individual loudspeaker groups should likewise also be set before the start of an automatic equalizing process. This may be done manually or automatically. The step-by-step procedure for automatic matching in one preferred embodiment is described, by way of example, as follows:

1. Automatic matching of the maximum values of the magnitudes of the frequency responses of all the broadband loudspeaker groups to the highest value, so that the quieter loudspeaker groups down to the quietest loudspeaker group are raised to the maximum value of the magnitude of the frequency response of the loudest loudspeaker pair.
2. Automatic matching of the averaged levels of the broadband loudspeaker groups, which have already been equalized automatically and individually in advance, to a target function.
3. Formation of the sum of the magnitudes of the frequency responses of the broadband loudspeakers whose levels have in the meantime been matched.
4. Setting of the channel gains of the woofer loudspeakers to the maximum value or to the mean level of the sum of the magnitudes of the frequency responses of the broadband loudspeakers.
5. Formation of the new sum of the magnitudes of the frequency responses of the broadband loudspeakers including the woofer loudspeakers.
6. Setting of the channel gain of the sub-woofer loudspeaker to the new maximum value or to the mean level of the new sum of the magnitudes of the frequency responses of the broadband loudspeakers, including the woofer loudspeakers from 5.

Furthermore, the maximum values of the levels and/or the mean values of the levels can optionally also be assessed for the steps 1-6 described above, before matching with the A-assessed level. As described further above, the A-assessment represents a frequency-dependent correction of measured sound levels that simulates the physiological hearing capability of the human ear.

In contrast to the use of crossover filters, FIR filters, whose advantages have already been described further above, are used in the implementation of the filters as determined for the automatic equalizing (AutoEQ) in the amplifier of a sound system. Since, depending on the embodiment and in particular when they have a wide bandwidth, these FIR filters can result in stringent requirements for the computation power of a digital signal processor on which they are carried out, the psycho-acoustic characteristics of the human hearing are made use of again in this case, as well. According to an aspect of the invention this is achieved in that the filtering is carried out by FIR filters via a filter bank, with the bandwidth of the filters increasing as the frequency increases, in a manner which corresponds to the frequency-dependent, integrating characteristic of the human hearing.

The modeling of the psycho-acoustic hearing sensitivities is in this case based on fundamental characteristics of the human hearing, in particular of the inner ear. The human inner ear is incorporated in the so-called petrous bone, and is filled with incompressible lymph fluid. In this case, the inner ear is in the form of a worm (cochlea) with about 2.5 turns. The cochlea in turn comprises channels which run parallel, with the upper and lower channel being separated by the basilar lamina. The cortical organ with the hearing sense cells is located on this lamina. When the basilar lamina is caused to oscillate by sound stimuli, so-called moving waves are formed during this process, that is to say there are no oscillation antinodes or nodes. This results in an effect that governs the hearing process, the so-called frequency/location transformation on the basilar lamina, which can be used to explain psycho-acoustic concealment effects and the pronounced frequency selectivity of the hearing.

In this case, the human hearing comprises different sound stimuli that fall in limited frequency ranges. These frequency bands are referred to as critical frequency groups or else as the critical bandwidth CB. The frequency group width has its basis in the fact that the human hearing combines sounds that occur in specific frequency ranges, in terms of the psycho-acoustic hearing sensitivities which result from these sounds, to form a common hearing sensitivity. Sound events that are within a frequency group in this case produce different influences than sounds which occur in different frequency groups. Two tones at the same level within one frequency group are, for example, perceived as being quieter than if they were in different frequency groups.

Since a test tone within a masker is audible when the energy levels are the same and the masker falls in the frequency band which the frequency of the test tone has as its mid-frequency, it is possible to determine the desired bandwidth of the frequency groups. At low frequencies, the frequency groups have a bandwidth of 100 Hz. At frequencies above 500 Hz, the frequency groups have a bandwidth that corresponds to about 20% of the mid-frequency of the respective frequency group (Zwicker, E.; Fastl, H. Psycho-acoustics—Facts and Models, 2nd edition, Springer-Verlag, Berlin/Heidelberg/New York, 1999).

If all of the critical frequency groups are arranged in a row over the entire hearing range then this results in a hearing-oriented non-linear frequency scale which is referred to as tonality, with the Bark as the unit. This represents a distorted scaling of the frequency axis, so that frequency groups have the same width of precisely 1 Bark at each point. The non-linear relationship between the frequency and tonality originates from the frequency/location transformation on the basilar lamina. The tonality function has been stated by Zwicker (Zwicker, E.; Fastl, H. Psycho-acoustics—Facts and Models, 2nd edition, Springer-Verlag, Berlin/Heidelberg/New York, 1999) on the basis of monitoring threshold and loudness investigations, in tabular form. As can be seen, 24 frequency groups can actually be arranged in a row in the audibility frequency range from 0 to 16 kHz, so that the associated tonality range is 0 to 24 Bark.

Transferred to the application in a sound system amplifier according to an aspect of the invention, this means that a filter bank is preferably formed from individual FIR filters whose bandwidth is in each case 1 Bark or less. Although FIR filters are used for automatic equalizing as investigations progress and in order to produce embodiments, possible alternatives exist which, for example, comprise rapid convolution, the PFDFC algorithm (Partition Frequency Domain Fast Convolution Algorithm), WFIR filters, GAL filters or WGAL filters.

For automatic equalizing of the levels and/or amplitudes of the sound system, two different techniques were investigated, which are referred to in the following text as "MaxMag" and "Sequential". "MaxMag" in this case searches in the manner described further above in all of the available independent loudspeaker groups to find that which, in terms of its maximum or average level, is furthest away from the target function of the frequency profile and thus provides the greatest contribution to approximation to the target function by raising or lowering the level. If the maximum possible level change of the selected loudspeaker group, which is restricted to the region of predefined limit values, is in this case found not to be adequate for complete approximation to the target function, the value which is set for the selected loudspeaker group within the permissible limit values is that which allows the greatest possible approximation to the target function and, following this, the loudspeaker group which is selected and whose level is changed is that which now has the greatest level difference from the target function from the group of loudspeaker groups whose levels have not yet been matched. This method is continued until either the target function is reached with sufficient accuracy or the dynamic limits of the overall system, that is to say the permissible reductions or increases (limit values) by equalizers are exhausted within the respective loudspeaker groups.

In contrast, as has been described in detail above, the sequential technique processes the existing loudspeaker groups successively in a previously defined sequence, in which case the user can produce the described influence on the mapping of the staging by the previous definition of the sequence. In this case the automatic processing also attempts to achieve the best approximation to the target function just by equalizing of the first loudspeaker group within the permissible limits (dynamic range).

To further improve this technique, it was modified in such a way that each group no longer reaches its maximum dynamic limits at each frequency location but may now only act at the restricted dynamic range. The technique uses the ratio of the signal vectors of the relevant group to the existing sum signal vector at this frequency location as a weighting parameter. This avoids the first groups provided for processing being excessively (over a broad bandwidth) attenuated. With the introduction of the self-scaling target function, which is oriented on the minimum of the sum function and then scales the target function such that the minimum value of the sum transfer function in a predetermined frequency range is located exactly by the maximum permissible increase below the target function, this indicated the strengths and weaknesses of the two versions "MaxMag" and "Sequential".

However, this procedure can lead to the level profile of the first loudspeaker group, which is modified by equalizing using the described "sequential" method, being raised or lowered more than proportionally over a broad bandwidth while, in contrast, the other loudspeaker groups which are processed using the "sequential" method, are not subject to any changes, or only to minor changes, since the target function has already been largely approximated by the equalizing of the first loudspeaker group. One possibly disadvantageous effect in this case is that the first loudspeaker in the defined sequence may experience a major increase or attenuation as the result of this procedure, with the following loudspeaker groups remaining largely unchanged, so that the frequency range which is represented by the first loudspeaker group is more than proportionally amplified or attenuated, which could lead to a considerable discrepancy from the desired sound impression.

The "sequential" method was thus subsequently modified such that a single loudspeaker group may now no longer be raised or lowered within its theoretical maximum available dynamic range, but only within a dynamic range which is less than this. This reduced dynamic range is calculated from the original maximum dynamic range by weighting this original maximum dynamic range with a factor which is obtained from the ratio of the overall level of the relevant loudspeaker group to the totaled overall level from all of the loudspeaker groups in this frequency range in the relevant loudspeaker group, so that this factor is always less than unity and results in a restriction to the maximum dynamic range which can be regulated out for the relevant loudspeaker group. This reliably avoids the level profiles of the first loudspeaker groups that are processed in the sequence previously determined being undesirably strongly raised or lowered in the course of the automatic equalizing process.

In order to take account of this restriction to the maximum control range (dynamic range) of the loudspeaker groups, a modification has also been introduced in the target function to be achieved, in order always to ensure reliable approximation to the target function of the desired level and phase profile despite the reduced control range of the loudspeaker groups. In this case, the target function to be achieved is raised or lowered over its entire level profile (parallel shifting of the level profile without changing the frequency response, also referred to in the following text as scaling), such that, in predetermined frequency ranges, the interval between this target function and the sum function of the level profile of all the loudspeaker groups to be considered and to be adjusted by the automatic equalizing process is not greater than the maximum increase or decrease as determined using the above method in the level profile of the individual loudspeaker groups.

The specified frequency ranges in which the level profiles of the target function and sum function of all the loudspeaker groups are compared, may, for example be oriented to the transmission bandwidths of the loudspeaker groups being used, but preferably to the Bark scale, as explained further above, that is to say in the region of frequency-group wide frequency ranges or partial ranges, thus once again taking account of the physiological hearing capability of the human hearing in this case in particular tone level perception and volume sensitivity (loudness).

The results of the loudspeaker settings achieved by the two "sequential" and "MaxMag" techniques on the basis of the embodiment described above were obtained by hearing trials with suitable subjects, that is to say subjects with experience in the assessment of sound environments produced by sound systems. In this case, these trials were carried out to assess the major parameters of the hearing impression, such as location capability, tonality and staging for in each case four seat positions in the passenger compartment of a motor vehicle. These seat positions comprise the driver, front-seat passenger, rear left and rear right.

For the technique based on "MaxMag", these hearing trials showed the tonality of the sound impression was found to be highly positive both on the front seats and on the rear seats. One disadvantage in the assessment of the use of the "MaxMag" technique was that a deterioration in the localization and localization clarity and hence also of the staging, was perceived at all of the seat positions.

Because the process based on "MaxMag" for equalizing of the individual loudspeaker groups first of all places the major emphasis on that loudspeaker group whose variation (raising or lowering) approximates the sum function over all the loudspeaker groups with the greatest contribution to a predetermined target function, an automated process can result in an unsuitable processing sequence of the loudspeaker groups. For example, it is possible for a situation to occur in which the automated technique for equalizing first of all identifies, in the case of the loudspeaker group for the front loudspeakers, the greatest contribution for the desired approximation to the target function, and correspondingly strongly raises or lowers its level profile.

As is known from the descriptions provided further above, however, the front loudspeakers in particular contribute a major proportion to, for example, good staging and, furthermore, this relates to their transmission quality, they are relatively unproblematic in comparison to other loudspeaker groups in the sound system by virtue of the installation location and the loudspeaker quality which can thus be used. In a situation such as this, further loudspeaker groups which may have disturbing spectrum components that have an adverse effect on the location capability will no longer be included in the automatic equalizing process, resulting in the parameters becoming worse, in the manner which has been mentioned.

For the process based on the "sequential" method, the hearing trials resulted in very good channel separation and localization clarity for the offered audio signals in all seat positions. Although very good tonality was also achieved, at the front seat positions using the "sequential" method, this tonality at the rear seat position became considerably worse as a result of the variation of the loudspeaker groups dealt with first according to an aspect of the technique, with the degree of this deterioration increasing in proportion to the respective maximum permissible raising or lowering in the respective loudspeaker groups. This means that the process based on the "sequential" technique, despite the already introduced reduction in the maximum decrease or increase in the individual loudspeaker groups, in particular in the first loudspeaker groups in the predetermined sequence of processing, still results in an automatic technique producing excessive variation.

In the embodiments of the automatic equalizing process investigated so far, neither of the two techniques used always produce good results in the hearing tests carried out, although the "sequential" technique appeared overall to be advantageous in comparison to the "MaxMag" technique. Further modifications to the described techniques are investigated in the following text in order to achieve both good localization and good tonality in an automated process, and to achieve both of these at both the front and rear seat positions in the passenger compartment of a motor vehicle.

The further investigations have shown that, when using the "sequential" technique, an even greater restriction to the permissible reduction in the level of the loudspeaker groups, in particular of the first loudspeaker groups in the respective specified sequence, made it possible to achieve a result which was satisfactory for all seat positions even for tonality as the hearing sensitivity. This was not satisfactory at the rear seat positions with the previous embodiment for automatic equalizing. As mentioned further above, the target function to be achieved is raised or lowered over its entire level profile (scaling, parallel shifting of the level profile without variation of the frequency response), such that the interval between this target function and the sum function of the level profile of all the loudspeaker groups to be considered and to be adjusted by the automatic equalizing process is no greater in predetermined frequency ranges than the maximum permissible increase or decrease in the level profile of the individual loudspeaker groups in the respective frequency range.

This means that the target function to be approximated by the equalizing process is aligned by virtue of this scaling in its absolute position at the minimum level of the sum function of the level profile of all the loudspeaker groups to be considered, which generally leads to a reduction, which in some cases is considerable, in this target function to be approximated, since the sum function of the level profile of all the loudspeaker groups to be considered normally has a highly fluctuating profile with pronounced maxima, and, in particular, minima. It is thus desirable to vary the sum function of the level profile of all the loudspeaker groups to be considered in a previous processing step such that these pronounced maxima and in particular minima, no longer occur and, as a consequence of this, the matching or scaling of the absolute position of the target function to this sum function results in far less reduction in the original specified target function.

This is achieved in the following text by matching, which is referred to as "pre-equalizing" of the levels of the individual loudspeaker groups (not the sum function) to the target function of the level profile, with this pre-equalizing process being coordinated with the equalizing of the phases as already described further above and as carried out even before the equalizing, in which the phases are matched by equalizing such that signals from the respective loudspeaker groups arrive as far as possible in phase at the left ear and at the right ear. This previous pre-equalizing of the individual loud speaker groups also results in the sum function that results from the level profiles of the individual loudspeaker groups being approximated at this stage to the target function to such an extent that the problem described above of major reduction in the target function as a consequence of pronounced minima in the sum function no longer occurs.

The equalizing values determined in the course of the pre-equalizing process may in this case be used as initial values for the subsequent, final equalizing by the "sequential" technique. However, before the addition of the level profile over all of the loudspeaker groups, the levels of the loudspeaker groups as approximated to the target function in a first step by the pre-equalizing process must, however, be matched to one another within their frequency ranges which are bounded by the respectively associated crossover filters. This matching process is necessary because the efficiency of the various loudspeaker groups may be different, and it is desirable for each loudspeaker group to produce volume sensitivity that is as identical as possible, which, when the volume sensitivity is the same for the sound components of the various loudspeaker groups, can lead to these loudspeaker groups being operated at considerably different electrical voltage levels in order to produce these sound components.

The level difference between the groups is also amplified by the pre-equalizing process, because the dynamic range of the equalizer is designed such that major reductions, but only slight increases, are permitted. If the frequency response of a group differs to a major extent from the target function, a considerable level reduction must therefore be expected. Major level increases are therefore not permissible, because they will be perceived as disturbing, particularly in conjunction with high filter Q factors.

As it has been possible to verify in appropriate hearing trials and measurements, the desired result of the described technique is obtained in that, once the equalizing steps have been carried out, the transmission response of all the loudspeaker groups is maintained over a broad bandwidth and the loudspeaker groups each in their own right make a contribution to the overall sound impression, which leads to good tonality and the largest possible sweet spot at all four passenger locations under consideration.

Furthermore, the resultant sum transfer function, that is to say the addition of the level profiles over all of the loudspeaker groups, is approximated by the step of pre-equalizing in its own right to the target function of the desired level frequency response to such an extent that this target function need no longer be reduced to such a major extent in the scaling process with respect to the sum function minima, which are in consequence less pronounced. As described above, this is once again a precondition for the use according to an aspect of the invention of one of the two techniques already described ("sequential" and "MaxMag") for automatic equalizing of the sum of the level profiles of all the loudspeaker groups in the sound system, in order, in the end, also to obtain a balanced sound impression at all seat positions.

So far, equalizing of the loudspeakers has always been carried out in groups of more than one loudspeaker. However, more extensive investigations have shown that equalizing of each individual loudspeaker in all the loudspeaker groups (forming groups of only one loudspeaker each) on the basis of the magnitude and phase made it possible to achieve even better results, although this process resulted in the previously achieved strict symmetry of the sound field now no longer being obtained. In this case, the advantages of individual equalizing of all the individual loudspeakers was evident not only at one location in the passenger compartment of the motor vehicle, for example the driver's seat position, but also at the other seat positions.

One precondition for this is that the results of the transfer functions recorded binaurally at different seating positions using the described measurement technique are included with appropriate weighting in the definition of the equalizing filters. As expected, it was possible to achieve the best results by equal weighting of the binaurally measured transfer functions. This equated consideration of the spatial transfer functions of the left and right hemisphere leads to quasi-balanced acoustics in the vehicle interior even though the equalizing filters are now set on a loudspeaker-specific basis.

This equalizing process on an individual loudspeaker basis increases the number of filters to be considered individually by virtually 50%, since a dedicated equalizing filter and thus a dedicated filter coefficient set are now also required in each case in the technique for automatic equalizing, per loudspeaker, for the loudspeaker groups arranged symmetrically with respect to the longitudinal axis of the vehicle interior and whose transfer function as in the past in each case was equalized by a common equalizing filter. The additional complexity that results from this and the consequently more stringent requirements for the computation power of the digital signal processor for provision of the equalizing filters, appear in the opinion of the inventors to be justified, however, since the results of the hearing tests in some cases resulted in considerable and significant improvements in the perceived hearing impression.

The two-stage procedure described so far, with pre-equalizing followed by equalizing of the sum function of the transfer function of all the loudspeakers, was retained, with both pre-equalizing and equalizing now being carried out on a loudspeaker-specific basis, by virtue of the described advantages. In contrast to the previous sequence of the processing steps, the matching of the channel gain was, however, no longer carried out subsequently but after the pre-equalizing had been carried out. In this case, both the matching of the channel gains and the adjustment of the crossover filters are carried out directly as before, for each loudspeaker group.

This means that the transfer functions of the individual loudspeakers of a symmetrically arranged pair of stereo loudspeakers in each case have the same channel gain and the same crossover filter applied to them. This stipulation has been made since, in the course of the investigations, situations occurred in which, when using loudspeaker-specific channel gains, particularly in the case of woofer loudspeakers, major differences in some cases occurred in the individual channel gains, which shifted the sound impression in an unnatural and undesirable manner in space. Problems of the same type would also occur if the crossover filters were designed on a loudspeaker-specific basis. A loudspeaker-specific crossover filter would admittedly make it possible for each loudspeaker in a loudspeaker group, normally a loudspeaker pair, to be operated with maximum efficiency in its frequency range, but loudspeaker environments or installation conditions which are not the same can result in situations in which the transmission range of one loudspeaker in a loudspeaker group differs to a major extent from that of another loudspeaker in the same loudspeaker group. If the crossover filters in a situation such as this were designed on a loudspeaker-specific basis, this may likewise lead to undesirable spatial shifts in the resultant sound impression.

After carrying out the crossover filtering, the loudspeaker-specific pre-equalizing both of the phase response and of the magnitude frequency response, as well as the matching of the channel gain, fine matching of the sum transfer function is now carried out, that is to say of the sum of the level profiles of all the loudspeakers involved, to the target function. In contrast to the previous procedure, the process based on the "MaxMag" technique is in this case preferred to the process based on the "sequential" technique. Since the pre-equalizing process is now carried out on a loudspeaker-specific basis, only a small number of narrowband frequency ranges of individual loudspeakers now need to be modified by the filter in order to achieve the desired approximations of the target function, and the broadband and major level changes produced by the equalizing filters, which in the past when using the "MaxMag" technique have led to the undesirable results in terms of the location capability, no longer occur. The results of the hearing trials confirm that, for using the loudspeaker-specific pre-equalizing process, a good localization capability is now achieved even with the process for automatic equalizing based on the "MaxMag" technique, in which case the tonality was also additionally improved by the previous loudspeaker-specific pre-equalizing process.

In contrast, the use of the process based on the "sequential" technique in conjunction with loudspeaker-specific equalizing may now have considerable disadvantages, which are evident in the form of major spatial shifting of the sound impression. This is due to the fact that the first individual loudspeaker in the processing chain in the sequence defined in the "sequential" technique in the worst case have its transfer function in all of the relevant frequency ranges change, normally by being reduced, by the equalizing filters to such a major extent that the distance from the target function becomes minimal (as is the aim of this technique). If this aim has already been achieved adequately by the first individual loudspeaker, all of the subsequent loudspeakers would no longer be processed any further by the automatic algorithm, in particular and in addition not the partner in the balanced loudspeaker pair with which the individual loudspeaker whose transfer function has been changed is associated. This will result in a broadband and one-sided, for example, reduction in the level profile in the frequency range of the relevant individual loudspeaker, which would lead to undesirable spatial shifting of the location of the perception of the sound events.

If required, this effect may be counteracted by in each case still applying the process based on the "sequential" technique to each of the known loudspeaker groups jointly irrespective of the loudspeaker-specific pre-equalizing. However, investigations have shown that the changed initial situation resulting from the loudspeaker-specific pre-equalizing for the process of the equalizing based on the "sequential" technique leads to poorer results in comparison to the "sequential" technique with pre-equalizing being carried out in groups so that this technique was no longer considered any further subsequently in conjunction with loudspeaker-specific pre-equalizing.

A renewed investigation of the influence of non-linear smoothing showed that excessive smoothing (for example third averaging) led to a "lifeless", "soft" or "washed-out" sound impression, while in contrast, no smoothing or only weak smoothing (e.g., third/12 averaging) resulted in an excessively "hard", "piercing" sound impression. Therefore third/8 averaging may be a good compromise.

As stated further above, the crossover filters were adjusted manually in the course of the previous investigations, for simplicity reasons. In the following, an approach is searched for in order to carry out this adjustment process automatically as well, since the aim is to develop automatic equalizing, which is as comprehensive as possible and covers all aspects, of a sound system in a motor vehicle, including the adjustment of the crossover filters in the automatic equalizing process, as well.

The following disclosure relating to the automatic adjustment of the crossover filters is based on the assumption that Butterworth filters of a sufficient order are, in principle, sufficient for the desired delineation of the respective frequency response of the relevant loudspeaker. The empirical values of acousticians, maintained over many years, for the equalizing of sound systems show that fourth-order filters are adequate both for high-pass and low-pass filters in order to achieve the desired crossover filter quality. A higher-order filter would result in advantages, for example by having a steeper edge gradient, however the amount of computation time required for this purpose for implementation in digital signal processors would rise in a corresponding manner at the same time. Fourth-order Butterworth filters are therefore used in the following text.

Figure 3A:
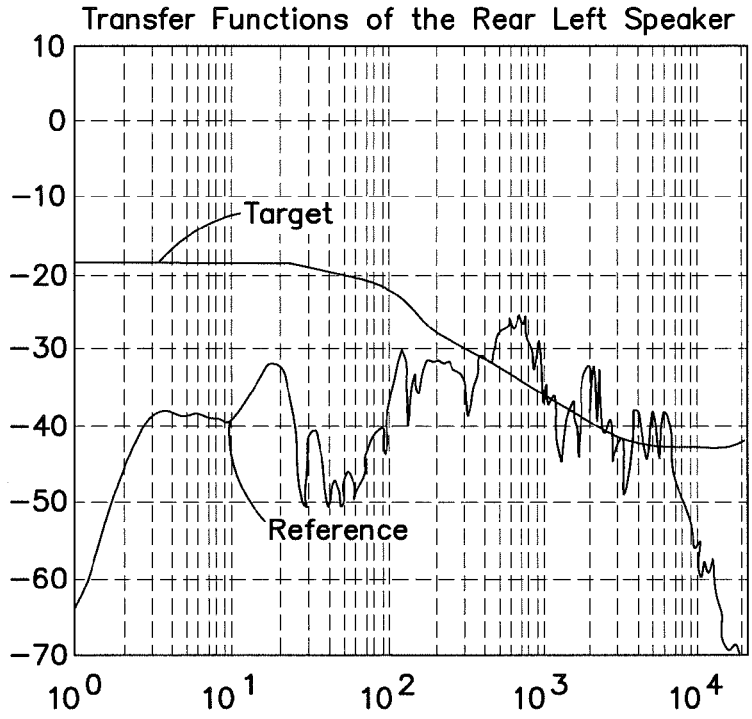
FIGS. 3A-3D illustrate a transfer function of a broadband loudspeaker and a technique for automatically finding the crossover frequencies.

The transfer function of the left rear loudspeaker, measured binaurally using the described measurement technique and averaged over the recordings at the driver's seat and the front-seat passenger's seat, is shown in comparison to the target function being used in the top left of FIG. 3A. As can be seen in this case, it appears from this illustration to be difficult, particularly in the lower frequency range, to define a lower cut-off frequency of the crossover high-pass filter from the profile of the measured transfer function in comparison to the profile of the target function. In contrast, a suitable upper cut-off frequency of a crossover low-pass filter can be determined quite easily in the present case.

Figure 3B:
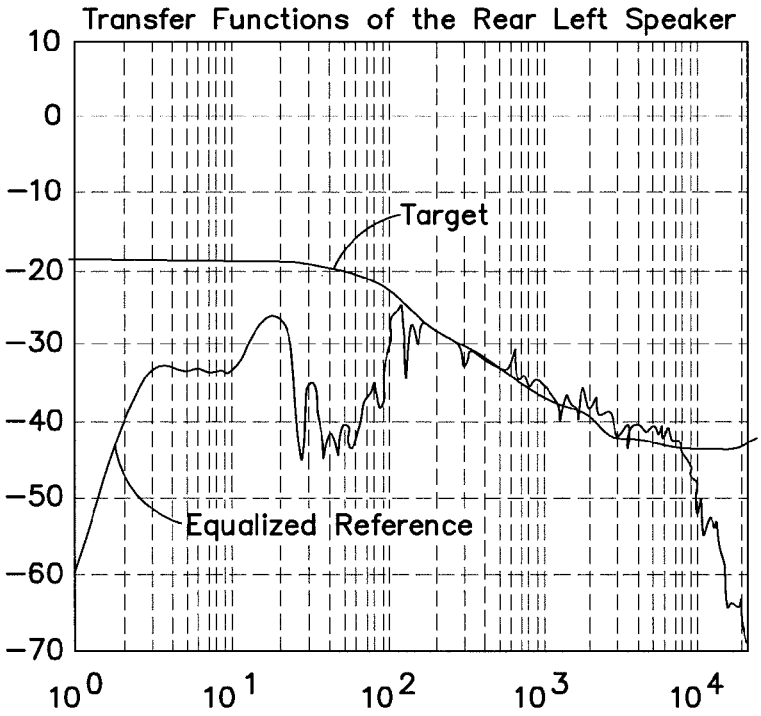

The right-hand upper illustration in FIG. 3B shows the same transfer function for the left rear loudspeaker, measured binaurally using the described measurement technique and averaged over the recordings at the driver's seat and front-seat passenger's seat in comparison to the target function used, after carrying out the pre-equalizing process according to an aspect of the invention. As can be seen, the range boundaries of the transfer function of the investigated broadband loudspeaker stand out in a significantly more pronounced manner and can be read from the graph without any difficulties. In this case, personnel who are experienced in this special field are assisted by practice in handling the representation and the meaning of such transfer functions. However, in conjunction with carrying out an automated equalizing process, this raises the question of how the definition of the cut-off frequencies of a crossover filter can be determined sufficiently accurately and reliably with the aid of a processing technique.

Figure 3C:
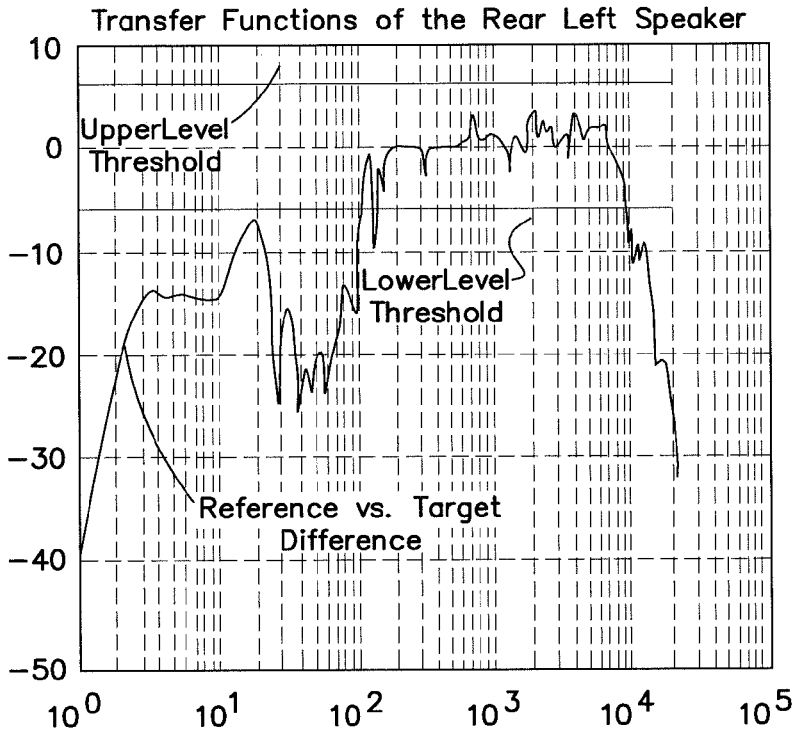
Figure 3D:
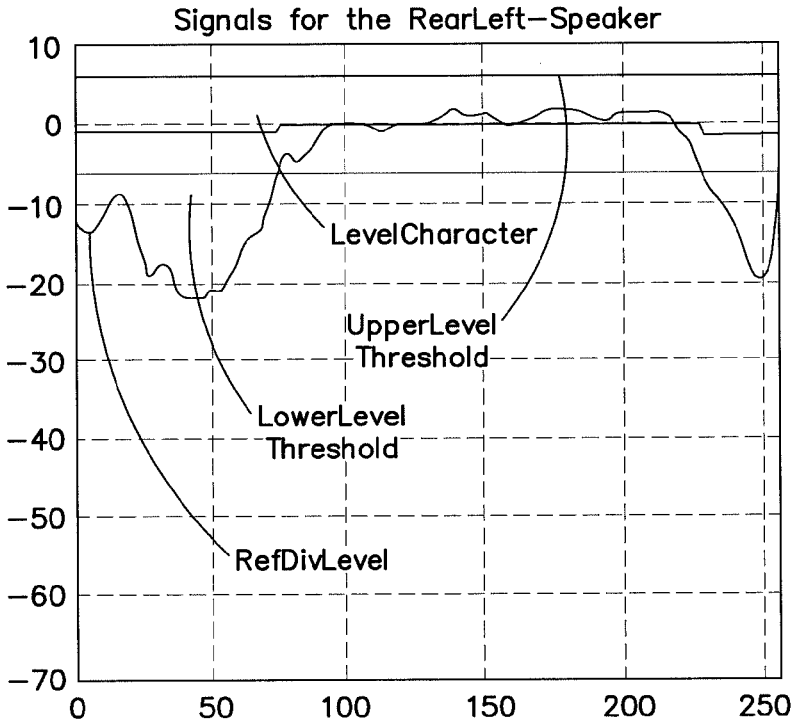

The processing technique which has been developed for this purpose is described in the following. In a first step, the difference is formed between the target function and the transfer function of the respective loudspeaker as determined after the pre-equalizing process. The result associated with the example under discussion is shown in the illustration at the bottom left in FIG. 3C. This difference transfer function, which is also referred to for short in the following text as the difference, is then investigated in the next step, to determine the frequency of this difference function at which it is within, above, or below a specific, predetermined limit range. The threshold values defined in the illustrated example form a symmetrical limit range with limits at, for example, +/−6 dB around the null point of the difference function which results at all frequencies at which the transfer function as determined after pre-equalizing at a level corresponding to the target function.

Since, as stated further above, the human hearing inter alia has a frequency resolution related to the frequency, the difference transfer function as calculated from the measured data and the target function was introduced into a level difference function, which had been smoothed by averaging, before evaluation of whether the limit range had been overshot or undershot. The mean value at the respective frequency is in this case preferably calculated from empirical values over a range with a width of ⅛ third octave band (in the following mentioned just as "third"). This means that the frequency resolution of the smoothed level difference function is high at low frequencies and decreases as the frequency increases. This corresponds to the fundamental frequency-dependent behavior of the human hearing to whose characteristics the illustration of the level difference function in FIGS. 3A-3D is thus matched.

The level difference spectrum is then smoothed once again in a further processing step with the aid of a first-order IIR low-pass filter in the direction from low to high frequencies and in the direction from high to low frequencies to eliminate bias problems and smoothing-dependent frequency shifts resulting from them. The level difference spectrum processed in this way is now compared by the automatic technique with the range limits (in this case +/−6 dB), and this is used to form a value for the trend of the profile of the level difference spectrum. In this case, the value "1" for this trend denotes that the upper range limit has been exceeded at the respective frequency of the level difference spectrum, while the value "−1" indicates that the lower range limit of the level difference spectrum has been undershot at the respective frequency, and the value "0" for the trend indicates level values of the level difference spectrum at the respective frequency which are within the predetermined range limits. The result in evaluations such as this can be seen in the illustration at the bottom right in FIG. 3D, with the graph in red showing the described and calculated trend of the level difference spectrum at the respective frequency.

Despite the described smoothing of the signal of the level difference spectrum before evaluation of the trend, if the level difference spectra are initially unknown in an automated technique, that is to say when using an automatic technique, it is possible for a situation to occur in which predetermined range limits are exceeded within a relatively narrow spectral range when, for example, the loudspeaker and/or the space into which sound is being emitted have/has a narrowband resonance point, and the profile of the level difference spectrum then falls again below the predetermined range limit (situations of the same type can also occur when the predetermined range limits are undershot). In situations such as these, the previously described technique cannot determine clear cut-off frequencies for the crossover filters.

Thus, in a further processing step, the level values determined by averaging using a filter in each case with a width of ⅛ third are thus investigated for the frequency of successive overshoots and undershoots of the predetermined range limits. Only when a specific minimum number (which can be predetermined in the algorithm) of related overshoots and undershoots of the predetermined range limits is overshot at successive frequency points is this interpreted by the technique as reliable overshooting or undershooting of the predetermined range limits, and thus as a frequency position of a cut-off frequency of the crossover filter. In the present case, with range limits of +/−6 dB and with smoothing of the level profile using filters with a width of ⅛ third, and a level spectrum resulting from this with discrete level values separated by ⅛ third, this minimum number of associated level values that overshoot or undershoot the range limits (+1-6 dB) is typically about 5-10 level values.

Depending on whether the respective loudspeakers that are being dealt with by the technique are loudspeakers designed to have a broadband or narrowband transmission response, upper and lower frequency ranges are predetermined within which the upper and lower cut-off frequency of the respective loudspeaker type will move, from experience, or on the basis of the characteristic data for that loudspeaker. In this way, the automatic algorithm can be designed to be very robust and appropriate by the addition of parameters or parameter ranges known in advance. In the case of the broadband loudspeakers that are used in the present case, by way of example, a minimum, lower cut-off frequency of $f_{gu}$=50 Hz can be assumed, while in the case of narrowband loudspeakers (woofers) used in the low-tone range, an upper cut-off frequency of $f_{go}$=500 Hz can be assumed. If the largest found and related level overshoot or level undershoot range is now located within the frequency range delineated in this way, the extreme value of the level overshoot and/or level undershoot is now looked for within this frequency range (maximum and minimum in the level profile).

If, in this case, this extreme value of the largest found and related level overshoot or level undershoot range is in this case below a specific cut-off frequency (for example about 1 kHz), and if this extreme value furthermore also has a negative value (minimum), then the decision is made to use a high-pass filter for the sought crossover filter. In order to find the cut-off frequency of this high-pass filter, a search is now carried out, starting from the frequency of the minimum, in the direction of higher frequencies within the level difference function as determined after pre-equalizing for its first intersection with the 0 dB line. This frequency denotes the filter cut-off frequency of the crossover high-pass filter.

If the extreme value of the largest found and related level overshoot or level undershoot range is above a specific cut-off frequency (for example about 10 kHz), and if this extreme value furthermore also has a negative value (minimum), then the decision is made to use a low-pass filter for the sought crossover filter. In order to find the cut-off frequency of this low-pass filter a search is now carried out starting from the frequency of the minimum in the direction of lower frequencies within the level difference function as determined after pre-equalizing, for its first intersection with the 0 dB line. This frequency denotes the filter cut-off frequency of the crossover low-pass filter.

If a plurality of extreme values exist, in which case at least the two most pronounced must be of a negative nature, and if the first minimum is below a specific cut-off frequency (for example about 1 kHz) and the other minimum is above a specific cut-off frequency (for example about 10 kHz), then the decision is made to use a bandpass filter for the sought crossover filter. In order to find the cut-off frequencies of this bandpass filter, a search is now carried out starting from the frequency of the minimum which is below the cut-off frequency of, for example, about 1 kHz in the direction of higher frequencies within the level difference function determined after the pre-equalizing, for its first intersection with the 0 dB line, and from the other minimum from its frequency in the direction of lower frequencies, for the first intersection with the 0 dB line. These frequencies then denote the filter cut-off frequencies of the crossover bandpass filter as the result of the automatic technique according to an aspect of the invention. If applied to the example as illustrated in FIGS. 3A-3D, this results in a crossover bandpass filter with a lower cut-off frequency of $f_{gu}$=125 Hz and an upper cut-off frequency of $f_{go}$=7887 Hz.

The crossover filter cut-off frequencies for all of the broadband loudspeakers in the medium and high-tone range of the sound system to be regulated and to be equalized are determined and set in the manner described above. The crossover filter cut-off frequencies of the narrowband low-tone loudspeakers must be dealt with separately, in further steps, and are restricted here just to logical range limits which, however, still need not represent final values. In general, the lower range limit of the crossover filters for the low-tone loudspeakers remains after the above processing at its lower cut-off value of $f_g$=10 Hz while, in contrast, the upper range limit is generally governed by the lowermost cut-off frequency of all of the broadband loudspeakers, provided that this is greater than the lower cut-off frequency of the broadband loudspeakers (for example about 50 Hz). This prior stipulation is important for the described technique because, once all of the crossover filter cut-off frequencies have been set, the complete automatic equalizing process (AutoEQ) is carried out once again to achieve a more accurate approximation to the target function, with the crossover filters being taken into account, in a second run. The final range limits of the crossover filters for the low-tone loudspeakers can then be looked for as will be described in the following text.

Once, as described above, the crossover filters of all of the broadband loudspeakers have been defined and the crossover filters of the narrowband loudspeakers in the low-tone range have been preset to suitable values, the search for better filter cut-off frequency values for the low-tone loudspeakers can be started. This procedure is necessary because the frequency transition from the narrowband loudspeakers for low-tone reproduction to the broadband loudspeakers depends on the nature and number of the low-tone loudspeakers being used and thus cannot easily be determined in a comparable manner.

In principle, a distinction is drawn between two typical situations for adjustment of the crossover filter cut-off frequencies, with the lower spectral range of the low frequencies being modeled by only one sub-woofer or only one woofer stereo pair in the first situation and with the lower spectral range of the low frequencies being modeled by a woofer stereo pair together with a sub-woofer in the other situation. Irrespective of which of the two situations is appropriate, the crossover filter cut-off frequencies of the woofers are in this case defined and determined in the same way and a distinction is just drawn in the calculation of the crossover filter cut-off frequencies for the sub-woofer between the two situations mentioned above. The crossover filter cut-off frequencies of the sub-woofer are in this case calculated in the same way as that for the woofer stereo pair in the situation in which only one sub-woofer and no woofer stereo pair is used. Only in the situation in which a woofer stereo pair is also present in addition to the sub-woofer is the way in which the crossover filter cut-off frequencies of the sub-woofer are calculated changed.

Figure 4A:
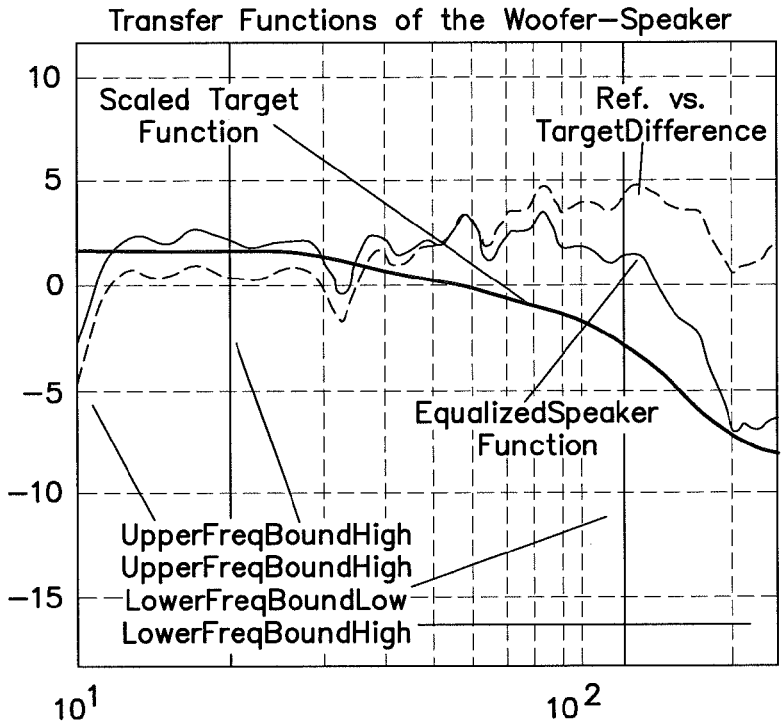
FIGS. 4A-4D illustrate a transfer function and the level function of a woofer loudspeaker pair or of an individual sub-woofer of a loudspeaker, and a technique for automatically finding the crossover frequencies.

As shown in the illustration at the top left in FIG. 4A, particularly in the case of the transition from the woofer loudspeakers to the broadband loudspeakers in the range from about 50 Hz to about 150 Hz, there is a peak in the sum magnitude frequency response (blue curve in FIG. 4A, illustration top left) with respect to the target function. In this case, it should be noted that the sum magnitude frequency response was formed only from the level contributions of the broadband loudspeakers and the level contributions of the woofer loudspeakers. Any sub-woofer loudspeaker that may be present is in this case ignored at this stage. To keep the peak in the sum magnitude frequency response within the transitional range as small as possible, or to match this transitional range to the target function as well as possible, as indicated by the boundary lines in the illustrations in FIGS. 4A-4D, a search for a difference that is as balanced as possible between the sum transfer function after pre-equalizing (blue curve FIG. 4A, illustration top left) and the target function (black curve in FIG. 4A, illustration top left) carried out only in an upper and lower spectral range. The upper spectral range within which a search is carried out for a minimum distance in this case results from the upper filter cut-off frequency of the woofer loudspeakers, which has already been determined prior to this, that is to say during the search for the crossover filter cut-off frequencies of the broadband loudspeakers. In this case, the minimum from the double upper filter cut-off frequency and the maximum permissible upper filter cut-off frequency of the low-tone loudspeakers which, as stated above, was defined to be $f_{go}$=500 Hz, determines the upper limit of the upper spectral range while half its value determines the associated lower limit of the upper spectral range. The lower limit of the lower spectral range for the search for the cut-off frequency results, in contrast to this, from the maximum of the minimum permissible lower filter cut-off frequency of the low-tone loudspeakers which, as stated above, was set to $f_{gu}$=10 Hz, and from half of the lower filter cut-off frequency, as already found. The upper limits of the lower spectral range for searching for the cut-off frequency results from twice the value of the lower limit.

Figure 4B:
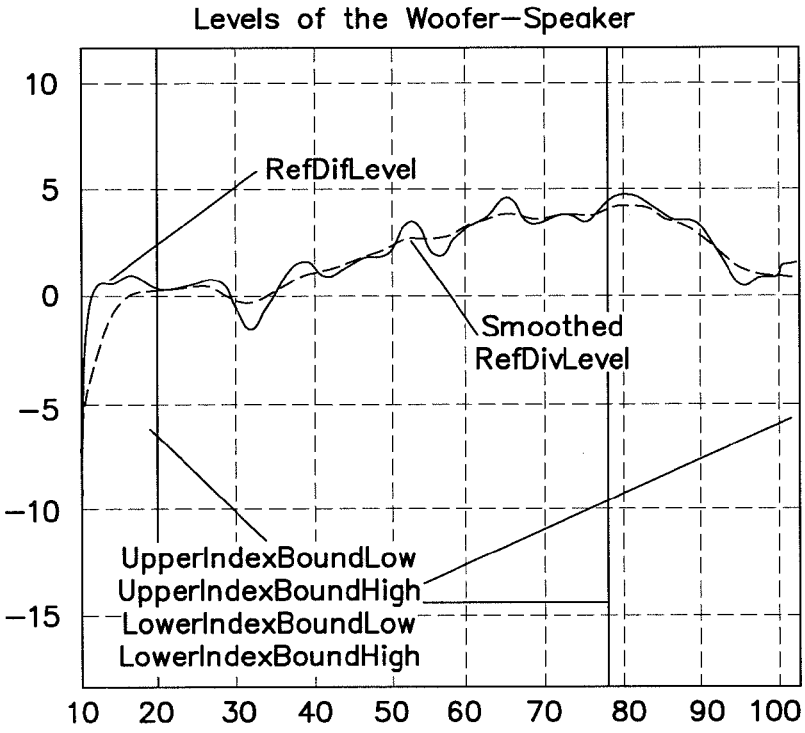
Figure 4C:
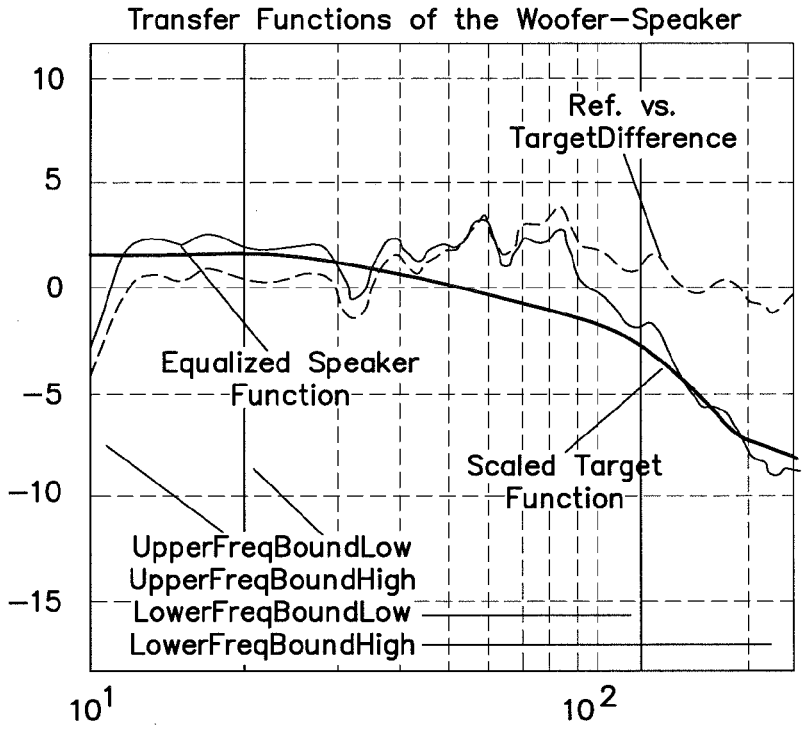
Figure 4D:
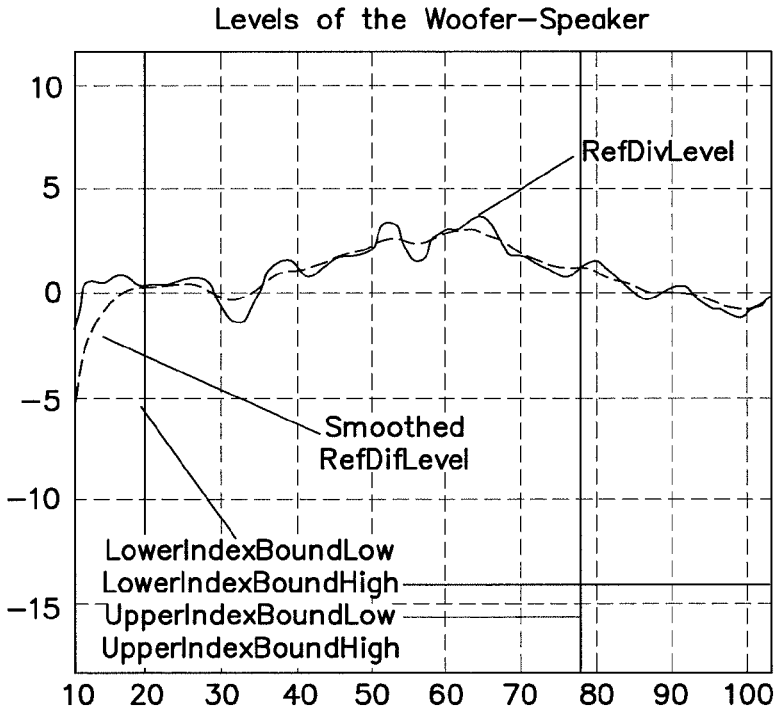

The decision as to whether the upper or the lower cut-off frequency of the crossover filter for the woofer loudspeakers should be reduced or increased is, however, not made directly from the profile of the difference between the sum magnitude frequency response and the target function (distance) but from the previously smoothed level profile, as is illustrated by way of example in the illustration top right in FIG. 4B.

As mentioned further above, the procedure for determination of the crossover filter cut-off frequencies for the relevant loudspeakers or loudspeaker groups is identical in the situation in which the sound system either comprises only a single sub-woofer loudspeaker, or a stereo pair formed from woofer loudspeakers. The following text explains and describes the transfer functions and level profiles of a single sub-woofer or of a woofer stereo pair, as well as the procedure for determination of the associated crossover filter cut-off frequencies.

In this case, once again the filter cut-off frequency or the filter cut-off frequencies of the sought crossover filter for the woofer loudspeakers has or have its or their frequency varied within the permissible limits of the lower or upper spectral range, respectively, for as long as it is possible in this way to reduce the magnitude of the mean value, formed from the profile of the difference between the sum magnitude frequency response and the target function (distance). If the magnitude of the mean value of the distance of the upper spectral range is in this case greater than that of the lower spectral range, depending on whether the mean value of the distance of the upper spectral range is positive or negative, the filter cut-off frequency of the upper crossover filter is reduced at most until the filter cut-off frequency of the lower crossover filter is reached, or is increased at most until the maximum permissible filter cut-off frequency of the low-tone loudspeakers (about 500 Hz) is reached. If, in contrast to this, the magnitude of the mean value of the distance in the upper spectral range is less than the mean value of the distance in the lower spectral range then, depending on whether the mean value of the distance of the lower spectral range is positive or negative, the filter cut-off frequency of the lower crossover filter is reduced at most until the minimum permissible filter cut-off frequency of the low-tone loudspeakers (about 10 Hz) of the lower crossover filter is reached or is increased at most until the filter cut-off frequency of the upper crossover filter is reached.

After the appropriate number of runs, this technique leads to crossover filters whose filter cut-off frequencies are set such that they have reached either their minimum or their maximum permissible range limits, or are located within the frequency range predetermined by these range limits and are set such that the magnitude of the mean value of the distance between the lower range limits of the lower spectral range and the upper range limits of the upper spectral range is minimized. This is illustrated, once again by way of example, in the two lower illustrations in FIGS. 4A-4D, with the left-hand illustration once again showing the magnitude frequency responses of the transfer function and the right-hand illustration showing the frequency responses of the level functions. As mentioned further above, this technique is used when the sound system either has only a single sub-woofer loudspeaker for low-tone reproduction or has only one stereo pair, formed from woofer loudspeakers.

The following text describes the procedure for determination of the cut-off frequencies of the crossover filters for the situation in which the sound system comprises not only the stereo pair as described above, formed from woofer loudspeakers, but at the same time, in addition to this, a sub-woofer loudspeaker as well. The technique according to an aspect of the invention is in this case dependent on the filter cut-off frequencies of the crossover filters for the stereo pair that is formed from woofer loudspeakers in this situation being calculated in advance and being already available, since these are used as input variables for determination of the filter cut-off frequencies of the crossover filter for the sub-woofer.

In order to set the filter cut-off frequencies of the crossover filter for the sub-woofer loudspeaker, its upper cut-off frequency is first of all set as a start value to the value of the upper cut-off frequency of the upper crossover filter of the woofer loudspeakers, and the already previously determined lower filter cut-off frequency is used to determine the new lower and upper range limits for the permissible filter cut-off frequencies in the same way as that which has already been described for the woofer loudspeakers.

This further restriction to the permissible frequency range of the upper filter cut-off frequencies of the crossover filter for the sub-woofer by the algorithm, which generally represents a reduction in the frequency range in the direction of lower frequencies is necessary to prevent the sub-woofer from reproducing excessively high frequencies. The major object of a sub-woofer which is optionally used as a single loudspeaker in the sound system is to reproduce a sound component in a frequency range in which the human hearing cannot carry out any spatial location. The range of operation of a sub-woofer in this case ideally covers the frequency range up to about 50 Hz, with this being dependent on the respective installation situation and the characteristics of the area into which sound is intended to be output, so that, in principle, it therefore cannot be defined exactly in advance.

The filter cut-off frequencies of the crossover filters for the sub-woofer loudspeaker are now found in a different way than would be the case if the sub-woofer were to be the only loudspeaker responsible for reproduction of the low frequencies of the sound system. In a first step, the sum magnitude frequency responses are in each case determined for this purpose with and without inclusion of the sub-woofer loudspeaker and the corresponding target functions are determined for each of these two sum magnitude frequency responses, and the respectively associated difference transfer functions are calculated. These are then once again averaged using the described methods and are in each case changed to the appropriate level function.

Figure 5A:
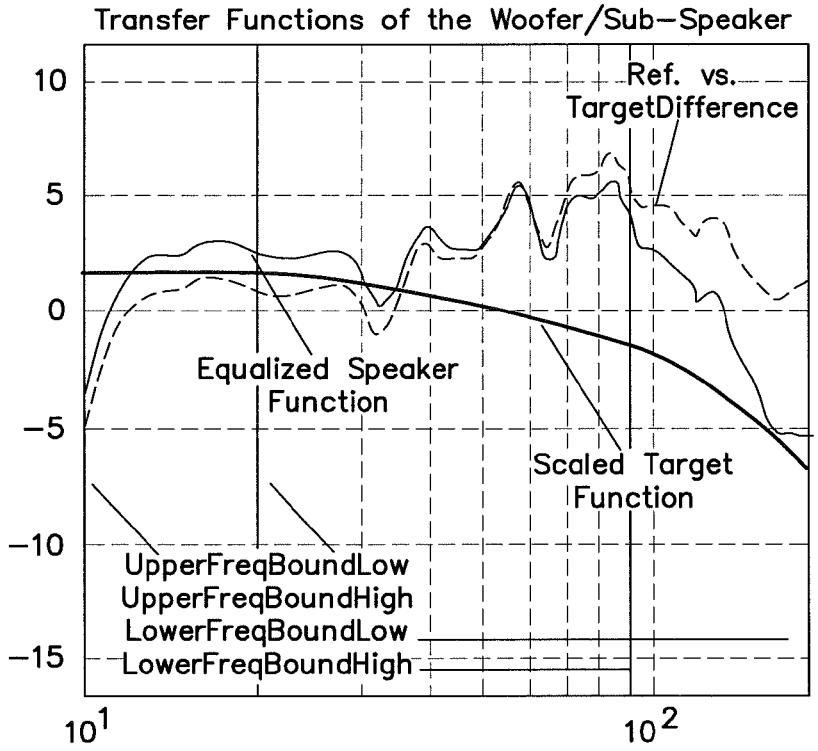
FIGS. 5A-5D illustrate transfer functions and level functions for the technique of automatically finding the crossover frequencies of a sub-woofer loudspeaker while at the same time using a woofer loudspeaker pair.
Figure 5B:
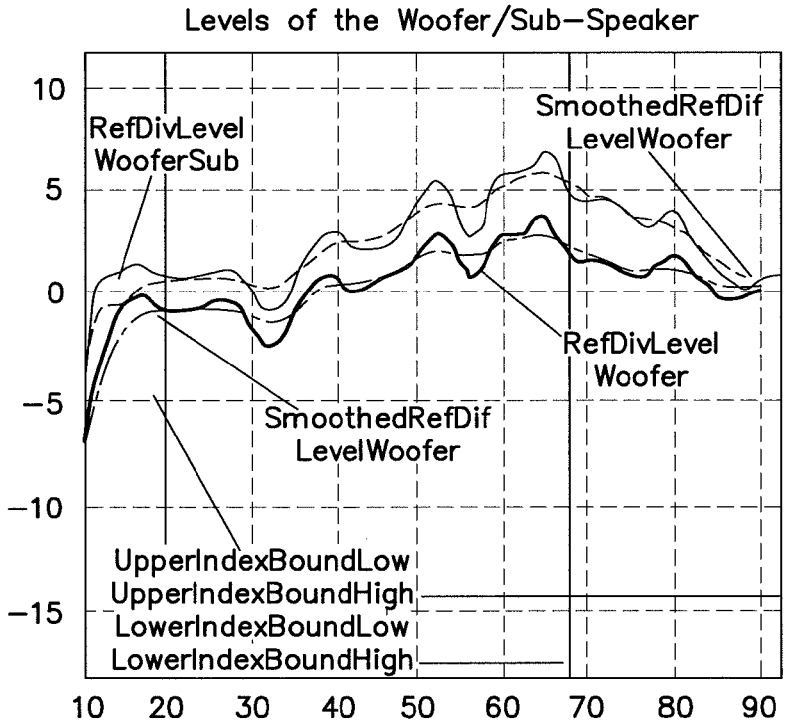

The top left illustration in FIG. 5A in this case shows the magnitude frequency responses of the target function, of the difference function as well as of the sum function including the sub-woofer and the range limits derived from this for the permissible upper and lower spectral range for the filter cut-off frequencies of the crossover filters for the sub-woofer loudspeaker. The top right illustration in FIG. 5B in contrast shows the unaveraged and averaged level functions of the differences, in each case with and without a sub-woofer. As can be seen from this, the difference function is increased by inclusion of the sub-woofer loudspeaker, that is to say the discrepancy is undesirably increased.

The filter cut-off frequencies of the crossover filters for the sub-woofer loudspeaker must therefore be changed by the algorithm in order once again to achieve a distance which is at least just as short from the target function, as was the case without consideration of the sub-woofer. This iterative technique is continued until the system including the sub-woofer is at a distance from the target function which is at most just as great as was the case previously for the sound system without a sub-woofer. In this case, the difference between the sound system without a sub-woofer loudspeaker, as previously determined in the processing step, and the target function is used as a reference for this iteration.

Figure 5C:
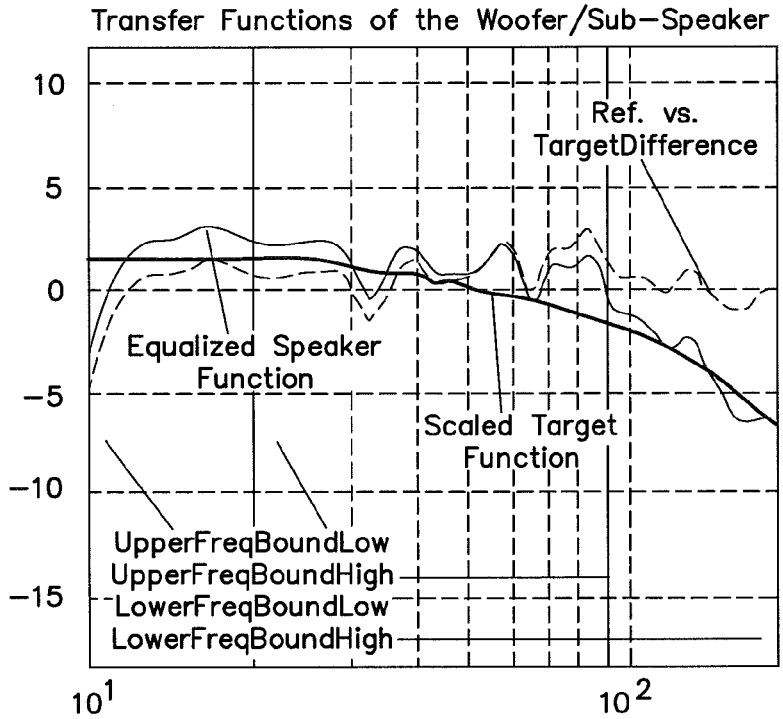
Figure 5D:
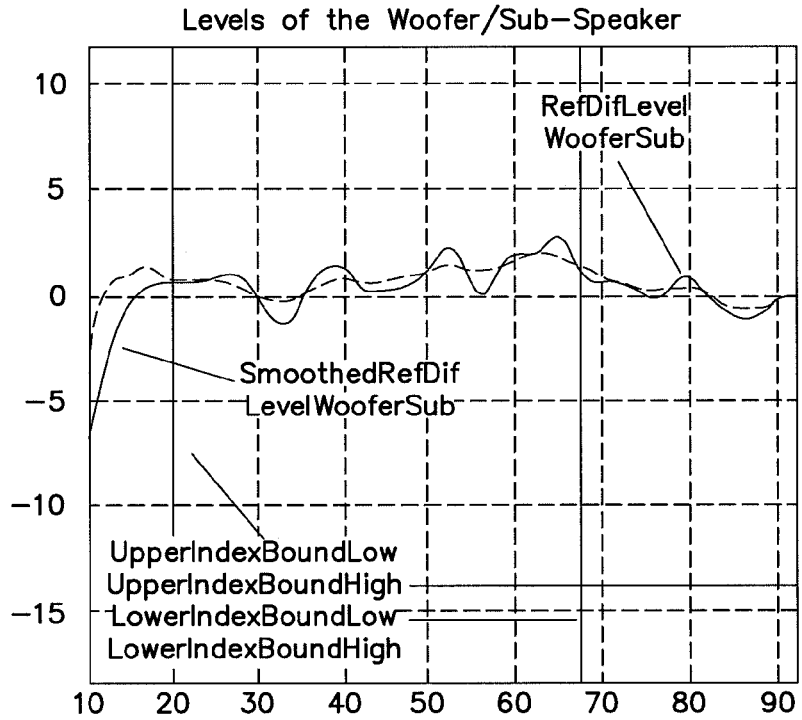

The resultant magnitude frequency responses after successful iteration are illustrated in the bottom left illustration of FIG. 5C, and the associated level frequency responses are illustrated in the bottom right illustration in FIG. 5D. This shows how the difference functions with the sub-woofer included behave before and after the iteration. After carrying out the iteration, the difference function, particularly in the upper of the two permissible spectral ranges for the filter cut-off frequencies of the crossover filters is considerably reduced, as desired, from the state before processing of the iteration.

Furthermore, a considerably more uniform profile of the difference function can now also be achieved overall than was previously the case without use of the sub-woofer. The reduction in the upper filter cut-off frequency of the crossover filter for the sub-woofer makes it possible to achieve a sum magnitude frequency response, by carrying out the automatic algorithm, whose distance from the target function is at the same time reduced and which furthermore has a more uniform profile, thus leading to a considerable improvement in the transfer function of the sound system in comparison to a sound system without use of a sub-woofer.

Figure 6:
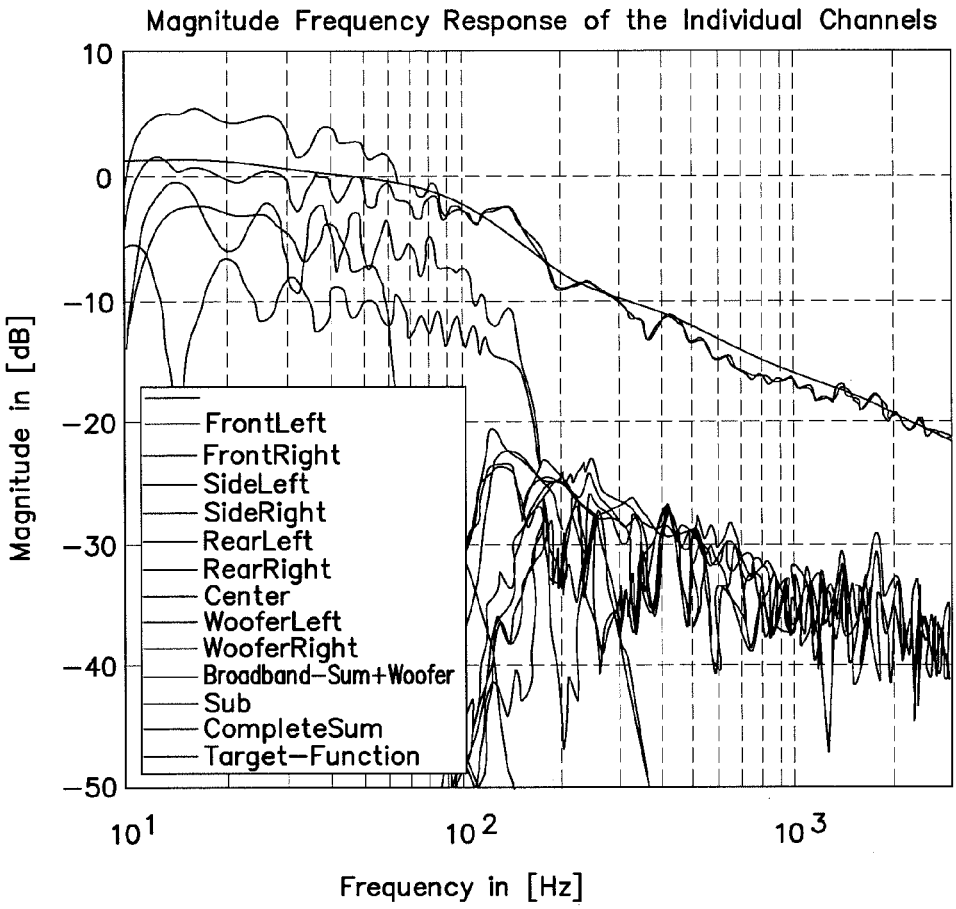
FIG. 6 illustrates magnitude frequency responses of all the loudspeakers and the resultant overall magnitude frequency response of a sound system including crossover filters after pre-equalizing has been carried out with and without sub-woofer loudspeakers.

Once all of the cut-off frequencies of the crossover filters have been determined using the technique described above, the complete automatic technique of the equalizing process is carried out once again, but with the previously determined cut-off frequencies of the crossover filters remaining fixed, and not being modified again in this repeated run. In this case, the impulse responses are determined using the crossover filters defined in the meantime, first of all for all of the individual loudspeakers in the sound system, as well as for all the loudspeakers jointly—once with and once without a sub-woofer—before running through the technique for automatic equalizing (AutoEQ) once again, that is to say once the phase equalizing and loudspeaker-specific pre-equalizing have already been carried out. The associated results are illustrated in FIG. 6. In this case, FIG. 6 shows the measured transfer functions for the front left and front right individual loudspeakers (FrontLeft and FrontRight in FIG. 6), for the left side and right side individual loudspeakers (SideLeft and SideRight in FIG. 6), for the rear left and rear right individual loudspeakers (RearLeft and RearRight in FIG. 6), for the woofer individual loudspeakers on the left and right (WooferLeft and WooferRight in FIG. 6), the center loudspeaker (Center in FIG. 6), the sub-woofer loudspeaker (Sub in FIG. 6), and for all of the loudspeakers jointly without any sub-woofer loudspeaker (Broadband-Sum+Woofer in FIG. 6) and for all of the loudspeakers jointly including a sub-woofer loudspeaker (Complete Sum), in this case all in comparison to the defined target function (Target Function in FIG. 6). In this case, the settings and values determined in the first run through the AutoEQ processing are likewise used for the loudspeaker-specific pre-equalizing filters and for the phase-equalizing filters.

In the next step, the process according to the "MaxMag" technique is used to form the optimized sum transfer function. The associated result is shown in FIG. 7, once again for the frequency range up to about 3 kHz that governs the localization capability and the tonality.

Figure 7:
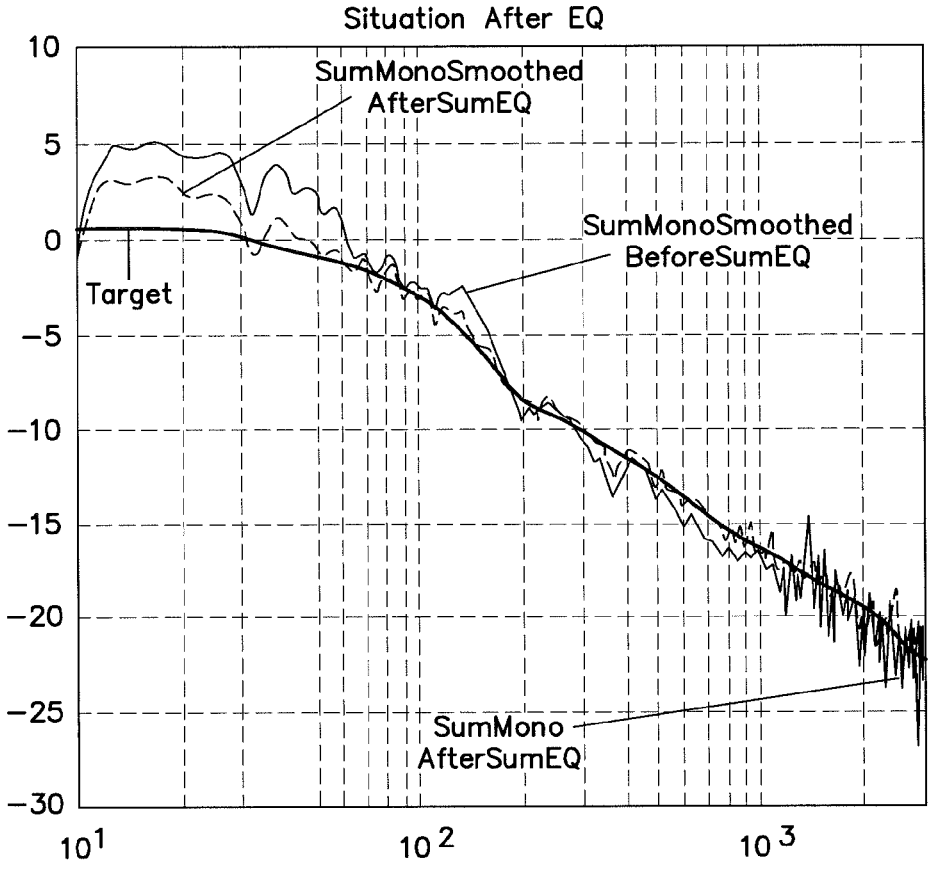
FIG. 7 illustrates overall magnitude frequency responses of the sound system before and after equalizing the overall magnitude frequency response.

As can be seen from FIG. 7, the equalizing of the sum function carried out in this run by the automatic processing using the "MaxMag" technique once again produces a better approximation to the target function in comparison to the sum function shown in FIG. 6. In this embodiment, only the lowest spectral range of the transfer function under consideration up to about 30 Hz exhibits a somewhat poorer approximation to the target function, with discrepancies up to about 3 dB. One major reason for this is the embodiment of the FIR filters that are used for the equalizing, in this case the FIR filter for the sub-woofer loudspeaker, which, in the present example, was limited to a maximum length of 4096 summation steps or sampling points in the calculation, irrespective of the frequency.

An increase in the number of summation steps for approximation of the FIR filter while at the same time increasing the requirement for memory and computation complexity in the digital signal processor to improve the approximation to the target function at very low frequencies is possible at any time, and when desired also for FIR filters at higher frequencies. Since the effect of limiting the length of the FIR filters in the present case slightly affected only the frequency range below 30 Hz, however, this maximum length of 4096 calculation steps was also retained subsequently for all the FIR filters.

Figure 8:
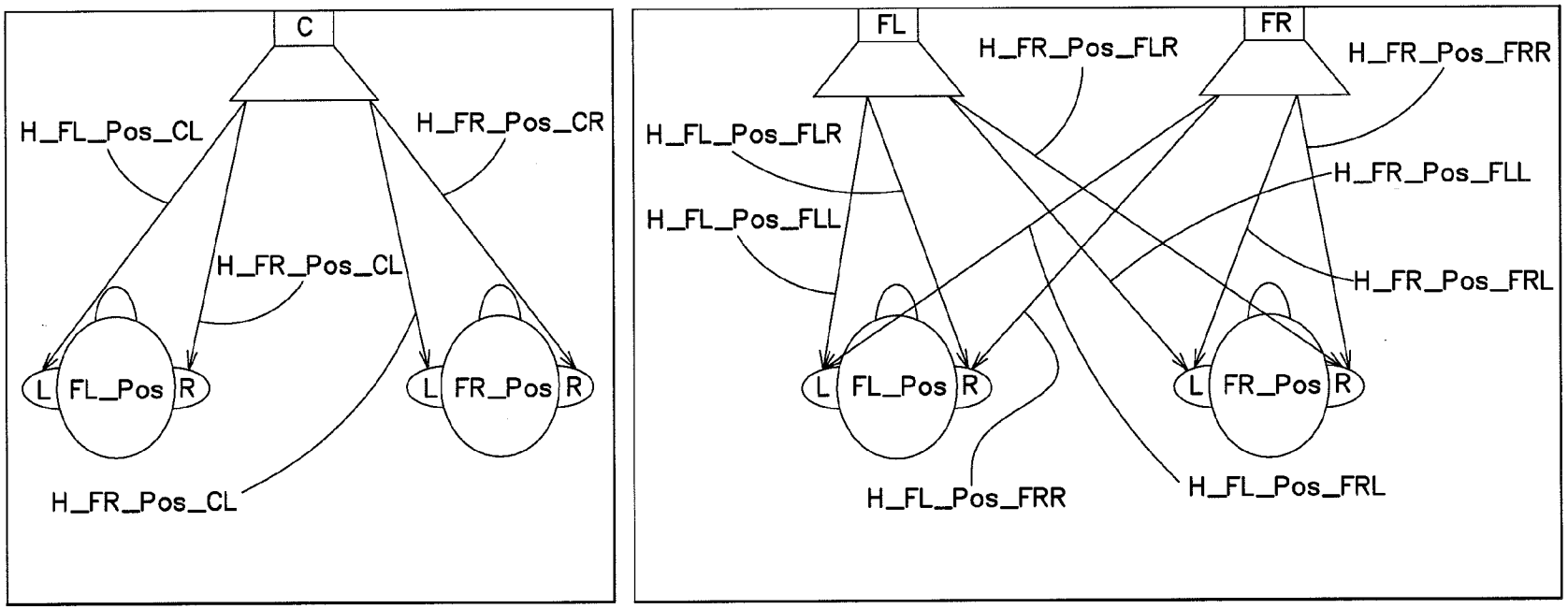
FIG. 8 illustrates a measurement arrangement in a motor vehicle for determination of the binaural transfer functions for mono signals and stereo signals.

The following text describes the procedure for measurement of the impulse responses of the sound system and the procedure for formation of the sum functions of the transmission frequency responses and of the associated level profiles as a function of the frequency. In this case, the left illustration in FIG. 8 shows the principle for the measurements of the binaural transfer functions for the front left and front right positions in the passenger compartment, using the example of the center loudspeaker C, which in this case represents an example of the presentation of mono signals. Furthermore, the left illustration in FIG. 8 shows the two front left FL_Pos and front right FR_Pos measurement positions and, associated with them, the positions simulated by the measurement microphones for the left ear L and the right ear R in each case at these measurement points. In this case, the transfer function from the center loudspeaker C to the left ear position L of the front left measurement position FL_Pos is annotated H_FL_Pos_CL, and the transfer function from the center loudspeaker C to the right ear position R of the front left measurement position FL_Pos is annotated H_FL_Pos_CR, the transfer function from the center loudspeaker C to the left ear position L of the front right measurement position FR_Pos is annotated H_FR_Pos_CL, and the transfer function from the center loudspeaker C to the right ear position R of the front right measurement position FR_Pos is annotated H_FR_Pos_CR. As mentioned initially, the localization of mono signals depends essentially on inter-aural level differences IID and inter-aural delay-time differences ITD, which are formed by the transfer functions H_FL_Pos_CL and H_FL_Pos_CR on the left front seat position, and by the transfer functions H_FR_Pos_CL and H_FR_Pos_CR on the right front seat position, respectively.

In contrast, the right-hand illustration in FIG. 8 shows the principle of the measurements of the binaural transfer functions for the front left and front right positions in the passenger compartment, using the example of the front loudspeaker pair FL (front left loudspeaker) and FR (front right loudspeaker), which in this case represent examples of the presentation of stereo signals. Furthermore, the right-hand illustration in FIG. 8 once again shows the two measurement positions, front left FL_Pos and front right FR_Pos, as well as the associated positions which are modeled by the measurement microphones respectively for the left ear L and the right ear R at these measurement points. In this case, the transfer function from the front left loudspeaker FL to the left ear position L at the front left measurement position FL_Pos is annotated H_FL_Pos_FLL, the transfer function from the front left loudspeaker FL to the right ear position R at the front left measurement position FL_Pos is annotated H_FL_Pos_FLR, the transfer function from the front left loudspeaker FL to the left ear position L of the front right measurement position FR_Pos is annotated H_FR_Pos_FLL, the transfer function from the front left loudspeaker FL to the right ear position R at the front right measurement position FR_Pos is annotated H_FR_Pos_FLR, the transfer function from the front right loudspeaker FR to the left ear position L at the front left measurement position FL_Pos is annotated H_FL_Pos_FRL, the transfer function from the front right loudspeaker FR to the right ear position R at the front left measurement position FL_Pos is annotated H_FL_Pos_FRR, the transfer function from the front right loudspeaker FR to the left ear position L of the front right measurement position FR_Pos is annotated H_FR_Pos_FRL, and the transfer function from the front right loudspeaker FR to the right ear position R at the front right measurement position FR_Pos is annotated H_FR_Pos_FRR. The transfer functions for the further loudspeaker groups, which are arranged in pairs and comprise the woofer, the loudspeakers arranged at the side and the rear loudspeakers, are obtained in a corresponding manner. The addition of the sum transfer functions and sum levels resulting from these transfer functions and the weightings of the measurement points, for the complete sum transfer function of the sound system, can easily be derived from the description of the situations for mono signals and stereo signals shown in FIG. 8, and will therefore not be described in detail here.

As already mentioned further above, the respective binaural transfer functions in the form of impulse responses of the sound system and of its individual loudspeakers and loudspeaker groups are, however, measured not only at the two front seat positions but also at the two rear positions, in the case of a vehicle which has a second row of seats. The technique can be extended to, for example, the seat positions in a third row of seats, for example as in minibuses or vans, by appropriate distribution of the weighting of the components for the seat positions at any time. However, the technique is not restricted to a vehicle interior but is also applicable with all kinds of rooms, for example living rooms, concert halls, ball rooms, arenas, railway stations, airports, etc. as well as under open air conditions.

For all of the embodiments, it can be stated in this case, that the large number of measured transfer functions of a single loudspeaker must be combined at the left and right ear positions at the respective seat positions to form a common transfer function, to obtain a single representative transfer function for each individual loudspeaker in the sound system, for automatic equalization processing. In particular, the weighting with which the transfer functions at the various seat positions are in each case included in the addition process for the transfer function, can in this case be chosen differently depending on the vehicle interior (vehicle type) and preference for individual seat positions.

By way of example, the following text describes a procedure which has been used in the course of the investigations relating to the present invention, although the invention is not restricted to this procedure. As described further above, for the addition of the transfer functions to form the overall transfer function of an individual loudspeaker, the respective components at the various seat position are weighted, to be precise, both for the magnitude frequency response and for the phase frequency response, at the various seat positions. The annotations for a vehicle interior with two rows of seats are in this case as follows:

- $\alpha$ the weighting of the component of the magnitude frequency response at the front left seat position,
- $\beta$ the weighting of the component of the magnitude frequency response at the front right seat position,
- $\gamma$ the weighting of the component of the magnitude frequency response at the rear left seat position,
- $\delta$ the weighting of the component of the magnitude frequency response at the rear right seat position,
- $\epsilon$ the weighting of the component of the phase frequency response at the front left seat position,
- $\Phi$ the weighting of the component of the phase frequency response at the front right seat position,
- $\phi$ the weighting of the component of the phase frequency response at the rear left seat position,
- $\eta$ the weighting of the component of the phase frequency response at the rear right seat position.

In this case, $\alpha=0.5$, $\beta=0.5$, $\gamma=0$ and $\delta=0$ are used for the weighting of the components of the magnitude frequency response for the examples described in the following text and $\epsilon=1.0$, $\Phi=0$, $\phi=0$ and $\eta=0$, are used for the weighting for the components of the phase frequency response, that is to say that, in this example, only the measurements of the two front positions are used with the same weighting (in each case 0.5) for the calculation of the resultant magnitude frequency response, and the measurements for the driver position (generally front left, as here) are used on their own for determination of the resultant phase frequency response. The hearing tests carried out showed that it was possible to achieve very good results at all seat positions even with this very rough weighting, but in principle the automatic technique is designed for any desired distribution of the weightings and, since hearing tests with a statistically significant number of test subjects at all seat positions are highly time-consuming, the improvements in the hearing impression that can be achieved beyond this will be the subject matter of future investigations. It should be noted that the sum of all the weightings of the transmission frequency responses and of the phase frequency responses at the various seat positions in each case results in the value unity, irrespective of the number of seat positions to be measured.

The combination of all of the transfer functions for all of the positions in the case of the center loudspeaker C (mono signal) for the microphone which in each case represents the left ear is accordingly:

$$\text{H_CL} = \begin{array}{c} \alpha * |\text{H_FL_Pos_CL}| + \beta * |\text{H_FR_Pos_CL}| + \\ \gamma * |\text{H_RL_Pos_CL}| + \delta * |\text{H_RR_Pos_CL}| * \\ e^{j * L}\left(\begin{array}{c} \varepsilon * \text{H_FL_Pos_CL} + \phi * \\ \text{H_FR_Pos_CL} + \varphi * \text{H_RL_Pos_CL} + \\ \eta * \text{H_RR_Pos_CL} \end{array}\right) \end{array}$$

and for the microphone which in each case represents the right ear:

$$\text{H_CR} = \begin{array}{c} \alpha * |\text{H_FL_Pos_CR}| + \beta * |\text{H_FR_Pos_CR}| + \\ \gamma * |\text{H_RL_Pos_CR}| + \delta * |\text{H_RR_Pos_CR}| * \\ e^{j * L}\left(\begin{array}{c} \varepsilon * \text{H_FL_Pos_CR} + \phi * \\ \text{H_FR_Pos_CR} + \varphi * \text{H_RL_Pos_CR} + \\ \eta * \text{H_RR_Pos_CR} \end{array}\right) \end{array}$$

The combined transfer functions determined in this way for the left and right microphones over all seat positions, in this case four seat positions, which correspond to the transfer functions added in a weighted form for the left and right ears, that is to say H_CL and H_CR, are then transformed from the frequency domain to the time domain using an inverse Fourier transform (IFFT) in which case only its real part is of importance here:

$$\text{h_CL} = \text{Re}\{IFFT\{\text{H_CL}\}\} \text{ and } \text{h_CR} = \text{Re}\{IFFT\{\text{H_CR}\}\}$$

In the next step, these real impulse responses are transformed back from the time domain to the frequency domain using the Fourier transform (FFT), and are then combined to form a transfer function of the H_C of the center loudspeaker C:

$$\text{H_CL} = FFT\{\text{h_CL}\} \text{ and } \text{H_CR} = FFT\{\text{h_CR}\} \rightarrow \text{H_C} = \text{H_CL} + \text{H_CR}$$

Furthermore, in the case of the loudspeaker pair comprising the front loudspeakers FL and FR (stereo signal), the combination of all the transfer functions of all the positions for the microphone which represents the left ear in each case and for the left front loudspeaker FL is:

$$\text{H_FLL} = \begin{array}{c} \alpha * |\text{H_FL_Pos_FLL}| + \beta * |\text{H_FR_Pos_FLL}| + \\ \gamma * |\text{H_RL_Pos_FLL}| + \delta * |\text{H_RR_Pos_FLL}| * \\ e^{j * L}\left(\begin{array}{c} \varepsilon * \text{H_FL_Pos_FLL} + \phi * \\ \text{H_FR_Pos_FLL} + \varphi * \text{H_RL_Pos_FLL} + \\ \eta * \text{H_RR_Pos_FLL} \end{array}\right) \end{array}$$

and for the microphone which in each case represents the right ear and the left front loudspeaker FL $$\text{H_FLR} = \begin{array}{c} \alpha * |\text{H_FL_Pos_FLR}| + \beta * |\text{H_FR_Pos_FLR}| + \\ \gamma * |\text{H_RL_Pos_FLR}| + \delta * |\text{H_RR_Pos_FLR}| * \\ e^{j * L}\left(\begin{array}{c} \varepsilon * \text{H_FL_Pos_FLR} + \phi * \\ \text{H_FR_Pos_FLR} + \varphi * \text{H_RL_Pos_FLR} + \\ \eta * \text{H_RR_Pos_FLR} \end{array}\right) \end{array}$$

and for the microphone which in each case represents the left ear, and the right front loudspeaker FR $$\text{H_FRL} = \begin{array}{c} \alpha * |\text{H_FL_Pos_FRL}| + \beta * |\text{H_FR_Pos_FRL}| + \\ \gamma * |\text{H_RL_Pos_FRL}| + \delta * |\text{H_RR_Pos_FRL}| * \\ e^{j * L}\left(\begin{array}{c} \varepsilon * \text{H_FL_Pos_FRL} + \phi * \\ \text{H_FR_Pos_FRL} + \varphi * \text{H_RL_Pos_FRL} + \\ \eta * \text{H_RR_Pos_FRL} \end{array}\right) \end{array}$$

and for the microphone which in each case represents the right ear and the right front loudspeaker FR $$\text{H_FRR} = \begin{array}{c} \alpha * |\text{H_FL_Pos_FRR}| + \beta * |\text{H_FR_Pos_FRR}| + \\ \gamma * |\text{H_RL_Pos_FRR}| + \delta * |\text{H_RR_Pos_FRR}| * \\ e^{j * L}\left(\begin{array}{c} \varepsilon * \text{H_FL_Pos_FRR} + \phi * \\ \text{H_FR_Pos_FRR} + \varphi * \text{H_RL_Pos_FRR} + \\ \eta * \text{H_RR_Pos_FRR} \end{array}\right) \end{array}$$

The combined transfer functions determined in this way for the left and right microphones are then transformed from the frequency domain to the time domain using the inverse Fourier transform (IFFT) over all seat positions, in this case four seat positions, which correspond to the transfer functions added in a weighted form for the left and right ear for the respective FL and FR loudspeakers, that is to say H_FLL, H_FLR, H_FRL and H_FRR, in which case, once again, only their real part is of importance here:

$$\begin{array}{l} \text{h_FLL} = \text{Re}\{IFFT\{\text{H_FLL}\}\};\ \text{h_FLR} = \text{Re}\{IFFT\{\text{H_FLR}\}\}; \\ \text{h_FRL} = \text{Re}\{IFFT\{\text{H_FRL}\}\};\ \text{h_FRR} = \text{Re}\{IFFT\{\text{H_FRR}\}\} \end{array}$$

In the next step, these real impulse responses are once again transformed from the time domain to the frequency domain using the Fourier transform (FFT), and are then combined to form a respective transfer function H_FL and H_FR for the left loudspeaker FL and for the right loudspeaker FR, respectively:

H_FLL = *FFT*{h_FLL} und H_FLR = *FFT*{h_FLR} → H_FL = H_FLL + H_FLR and

H_FRL = *FFT*{h_FRL} und H_FRR = *FFT*{h_FRR} → H_FR = H_FRL + H_FRR.

As the above formulae show, both phase components and magnitude components of the transfer function for each seat position in the passenger compartment of a motor vehicle can be included in the formation of the transfer functions which result in the end, depending on the chosen weighting. In this case, a number of different weightings have already been used in the investigations relating to this invention application, and these have led to the following provisional discoveries. Any such weighted superimposition of the phase frequency responses over more than one seat position resulted in a deterioration, in some cases a considerable deterioration, in the received acoustics in the vehicle. Furthermore, the deterioration was generally evident at every listening position, and was therefore not position-dependent.

For this reason, in the further investigations so far of the phase frequency response, the resultant, loudspeaker-dependent transfer function was made dependent exclusively on the measurements at the driver's position (generally front left), to be precise by combination of the phase frequency responses of the left and right microphones. None of the other phase frequency responses of the other seat positions were included. This stipulation was made initially to restrict the amount of effort associated with this, and in particular that relating to the hearing tests with a significant number of test subjects. More detailed investigations will have to be carried out relating to this to determine whether other constellations (weightings) of the superimposition of the phase frequency responses cannot be found which lead to a further improvement in the hearing impression. For example, one approach would be to use a position in the center of the passenger compartment or else the position between the two front seats as the only point for recording the impulse responses for calculation of the equalizing filters for the phase response.

A different impression was gained in the formation of the added magnitude frequency response. Because the AutoEQ algorithm is processed on a loudspeaker-specific basis and no longer in pairs, attention must now be paid to the symmetry between the left and right hemisphere in the formation of the resultant magnitude frequency response, that is to say the weighting values of the left measurement positions must correspond to those of the right measurement positions, in order to maintain this symmetry.

In this case, although a uniform weighting for all of the measurement positions would produce a good acoustic result, an even better result, however, has been achieved by using only the two front measurement positions to form the resultant magnitude frequency response. However, in this case as well, it is possible to achieve an even better result by also including the measurements of the rear positions, by suitable weighting in the formation of the resultant magnitude frequency response (e.g., $\alpha$=0.35, $\beta$=0.35, $\gamma$=0.15 and $\delta$=0.15).

Once the measurements as described above have been combined binaurally for each loudspeaker over all of the seat positions, the resultant transfer functions of the individual loudspeakers are split into their real and imaginary parts. For the present examples, this means, in the case of the mono signal from the center loudspeaker C:

ReC=Re{H_C} and ImC=Im{H_C} and for the stereo signal from the loudspeakers FL and FR:

ReFL=Re{H_FL} and ImFL=Im{H_FL} and

ReFR=Re{H_FR} and ImFR=Im{H_FR}

The respective phase frequency response of the respective loudspeakers are then determined from the real and imaginary parts, and the real and imaginary parts are then changed such that a desired phase shift of 0° is always achieved, that is to say purely real signals are produced. For the example of the mono signal (loudspeaker C), this means that the phase response of the signal of the loudspeaker C becomes:

$$PhaseC = -\arctan(\mathrm{Im}C_{old}/\mathrm{Re}C_{old})$$

and accordingly $$\mathrm{Re}C_{New} = \sqrt{\mathrm{Re}C_{Alt}^2 + \mathrm{Im}C_{Alt}^2} * \cos\left(\arctan\left(\frac{\mathrm{Im}C_{Alt}}{\mathrm{Re}C_{Alt}}\right) + PhaseC\right)$$

$$\mathrm{Im}C_{New} = \sqrt{\mathrm{Re}C_{Alt}^2 + \mathrm{Im}C_{Alt}^2} * \sin\left(\arctan\left(\frac{\mathrm{Im}C_{Alt}}{\mathrm{Re}C_{Alt}}\right) + PhaseC\right)$$

the new real and imaginary parts are obtained, which now have a phase shift of 0° over a broad bandwidth. A corresponding situation applies to the example of the stereo signal:

$$PhaseFL = -\arctan(\mathrm{Im}FL_{old}/\mathrm{Re}FL_{old})$$

$$PhaseFR = -\arctan(\mathrm{Im}FR_{old}/\mathrm{Re}FR_{old})$$

and accordingly $$\mathrm{Re}FL_{New} = \sqrt{\mathrm{Re}FL_{Alt}^2 + \mathrm{Im}FL_{Alt}^2} * \cos\left(\arctan\left(\frac{\mathrm{Im}FL_{Alt}}{\mathrm{Re}FL_{Alt}}\right) + PhaseFL\right)$$

$$\mathrm{Im}FL_{New} = \sqrt{\mathrm{Re}FL_{Alt}^2 + \mathrm{Im}FL_{Alt}^2} * \sin\left(\arctan\left(\frac{\mathrm{Im}FL_{Alt}}{\mathrm{Re}FL_{Alt}}\right) + PhaseFL\right)$$

$$\mathrm{Re}FR_{New} = \sqrt{\mathrm{Re}FR_{Alt}^2 + \mathrm{Im}FR_{Alt}^2} * \cos\left(\arctan\left(\frac{\mathrm{Im}FR_{Alt}}{\mathrm{Re}FR_{Alt}}\right) + PhaseFR\right)$$

$$\mathrm{Im}FR_{New} = \sqrt{\mathrm{Re}FR_{Alt}^2 + \mathrm{Im}FR_{Alt}^2} * \sin\left(\arctan\left(\frac{\mathrm{Im}FR_{Alt}}{\mathrm{Re}FR_{Alt}}\right) + PhaseFR\right)$$

Following these processing steps (equalizing of the phases) of the automatic technique, which has been described in more detail above, for equalizing of a sound system (AutoEQ) the pre-equalizing process is now carried out, as before, whose basic procedure is summarized as follows:

1.) Smoothing of the magnitude frequency response (preferably non-linearly with averaging over ⅛ third) of the respective loudspeaker.
2.) Scaling of the target function with respect to the already smooth, individual magnitude frequency response. In this case, the scaling factor of the target function is not calculated over a broad bandwidth, but is determined within a predetermined frequency range which is predetermined by the lower limit of $f_{gu}$=10 Hz and the upper limit of $f_{go}$=3 kHz and the respective limits for the associated, already determined and adjusted crossover filters.
3.) Determination of the distance between the individual, smoothed magnitude frequency response and the target function scaled onto it, before calculation of the pre-equalizing.
4.) Calculation of the pre-equalizing, which corresponds to the inverse profile of the difference between the scaled target function and the smoothed magnitude frequency response. In this case, the profile of the target function is restricted at the top and bottom ends corresponding to the maximum permissible increase and decrease if some of the values should overshoot or undershoot these range limits.

5.) Renewed calculation of the distance as in 3.), after application, however, of the pre-equalizing, as calculated in 4.), to the magnitude frequency response.

6.) Adoption of the filter coefficients of the pre-equalizing for those frequencies in which the magnitude of the distance after application of pre-equalizing is less than the distance as determined in 3.) before application of the pre-equalizing.

7.) Optional smoothing (preferably non-linearly with, for example, ⅛ third filtering) of the magnitude frequency response determined by the pre-equalizing.

8.) Transformation of the spectral FIR filter coefficient sets from the pre-equalizing to the time domain with the aid of the "frequency sampling" technique, and optional restriction of the length of the FIR filter coefficients in the time domain, with subsequent transformation back to the spectral domain.

9.) Determination of the crossover filter cut-off frequencies of the broadband loudspeakers and, optionally, initial allocation of the narrowband crossover filter cut-off frequencies.

10.) Storage of the individual pre-equalizing filter coefficient sets and, as previously determined, of the respective crossover filter cut-off frequencies.

Once the pre-equalizing filters have been calculated and stored and, if desired, the filter cut-off frequencies of the crossover filters as well as the individual values for the channel gain have been calculated and applied, the sum transfer function is calculated on the basis of the real and imaginary parts before the equalizing of the sum transfer function is then carried out using the "MaxMag" technique, as described in the following text:

1.) Smoothing of the sum magnitude frequency response (preferably non-linearly with ⅛ third filtering).

2.) Scaling of the target function with respect to the already smoothed sum magnitude frequency response. In this case, the scaling factor for the target function is not calculated over the entire audio spectral range but is determined within a predetermined frequency range, which is predetermined by the lower limit of $f_{gu}$=10 Hz and the upper limit of $f_{go}$=3 kHz, and the respective limits for the associated, already determined and adjusted crossover filters.

The following calculation steps as a loop over the frequency (0<f<=fs/2):

3.) Renewed calculation of the current sum transfer function based on the real and imaginary parts at the frequency f.

4.) Determination of the current distance between the sum transfer function and the target function at the point f.

5.) Resetting of the previous minimum distance, setting the distance to the new distance as determined in 4.), and incrementing of the counter (loop over frequency f).

Iteration:

6.) Calculation of all the filters for magnitude equalizing, based on the previously determined filters of the pre-equalizing at the frequency f.

7.) Limiting of the filters for the magnitude equalizing to the permissible raising and lowering range.

8.) Calculation of the individual magnitudes, and of the respective distances to the target function at the frequency f.

9.) After exclusion of all those values from the equalizing which have already reached the predetermined limits for raising or lowering, the search is carried out for that magnitude value with the maximum magnitude and the maximum distance.

10.) The individual loudspeaker that has the greatest distance and which, when its magnitude equalizing is changed at the point f, thus leads to the expectation of the maximum reduction in the distance of the sum transfer function in the direction of the target function, is then selected, and the associated function of the magnitude equalizing is modified at the relevant frequency f so that this leads to the desired reduction in the distance.

11.) The sum transfer function on the basis of the magnitude and phase is then calculated once again using the current parameters for the magnitude equalizing and then the calculation of the new difference between the previous distance and the distance determined in the current iteration step takes place. If the difference between the previous distance and the current distance is below a specific predetermined threshold value in this case, the iteration is finished. In any case, the iteration is terminated at the latest after carrying out a specific, predetermined number of iterations (for example 20), in order to avoid endless loops.

12.) Finally, the newly calculated distance is set as the current distance, and the process continues with the next iteration step.

Once the iteration of the equalizing of the sum transfer function has been ended, the filters that have been modified in the course of the iteration process are optionally smoothed again for the pre-equalizing (preferably matched to the hearing, non-linearly, for example with ⅛ third filtering), are then transformed to the time domain using the "frequency sampling" technique, and finally optionally have their length limited before being transformed back to the spectral domain, in this way resulting in the final filters for the magnitude equalizing. The FIR filters for the equalizing of the phases are in this case determined using the following method.

The profile of the filters for the equalizing of the phases is calculated individually for each loudspeaker to be:

PhaseEQ=−arctan(Im/Re)

This profile is broken down again, after optional smoothing, into its real and imaginary parts:

RePhaseEQ=cos(PhaseEQ) and ImPhaseEQ=
sin(PhaseEQ)

The spectra are then extended symmetrically on their two sideband spectrum, thus resulting in a real FIR filter being produced in the time domain:

RePhaseEQ=[RePhaseEQ RePhaseEQ(end−1:−1:2)]
and

ImPhaseEQ=[ImPhaseEQ−ImPhaseEQ(end−1:−1:2)]

The (complex) transfer function is then calculated from the real and imaginary parts:

H_PhaseEQ=RePhaseEQ+j*ImPhaseEQ.

In order to obtain a causal all-pass FIR filter, the filter has to be superimposed with a modeling delay, which ideally has half the FIR filter length:

H_PhaseEQ=H_PhaseEQ*H_Delay where H_Delay=FFT(Delay) and Delay=[1, 0, 0, . . . , 0] and has a length which corresponds to half the length of the FIR filter for the equalizing of the phases. The transfer function which has been modified in this way is once again transformed to the time domain, with its real part corresponding to the FIR filter coefficients of the filter for the equalizing of the phases:

h_PhaseEQ=Re {IFFT {H_PhaseEQ}}.

Convolution with the previously calculated filters for the equalizing of the magnitude frequency response finally results in the non-linear, loudspeaker-specific FIR filters for the equalizing, which are used both for the equalizing of the phases and for the equalizing of the magnitude frequency response of the sound system.

Figure 9:
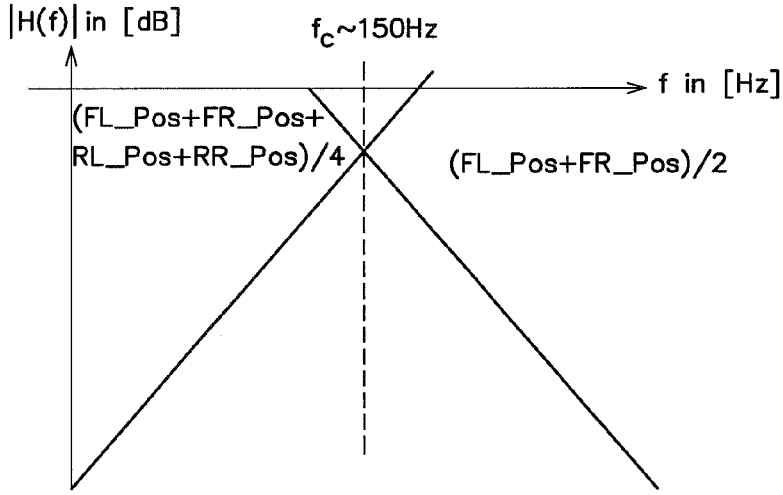
FIG. 9 illustrates the spectral weighting function for the measurement at different positions.

For a high symmetry and a high acoustical sound quality for a given listening position, a position specific equalizing may be based only on sound picked up in the position in view of only those loudspeaker positions which are relevant for the listening position. Further, channel (group) specific equalizing is applied in each position to the effect that only adjacent loudspeaker positions are used for the equalization to maintain symmetry. Thus, there are separate calculations for the front and rear positions. The front channels may include, for example, the front left and right channels (FL, FR) as well as the center speaker. Those speakers are only relevant for the front left and front right listening positions with respect to cross-over frequency, gain, amplitude, and phase. Accordingly, the left and right speakers in the rear are only used for the rear listening positions. However, all positions are influenced by the sound from the woofer. FIG. 9 shows in a diagram an exemplary spectral weighting function for measurements at different positions (FL_Pos+FR_Pos+RL_Pos+RR_Pos)/4 and (FL_Pos+FR_Pos)/2 over frequency.

Figure 10:
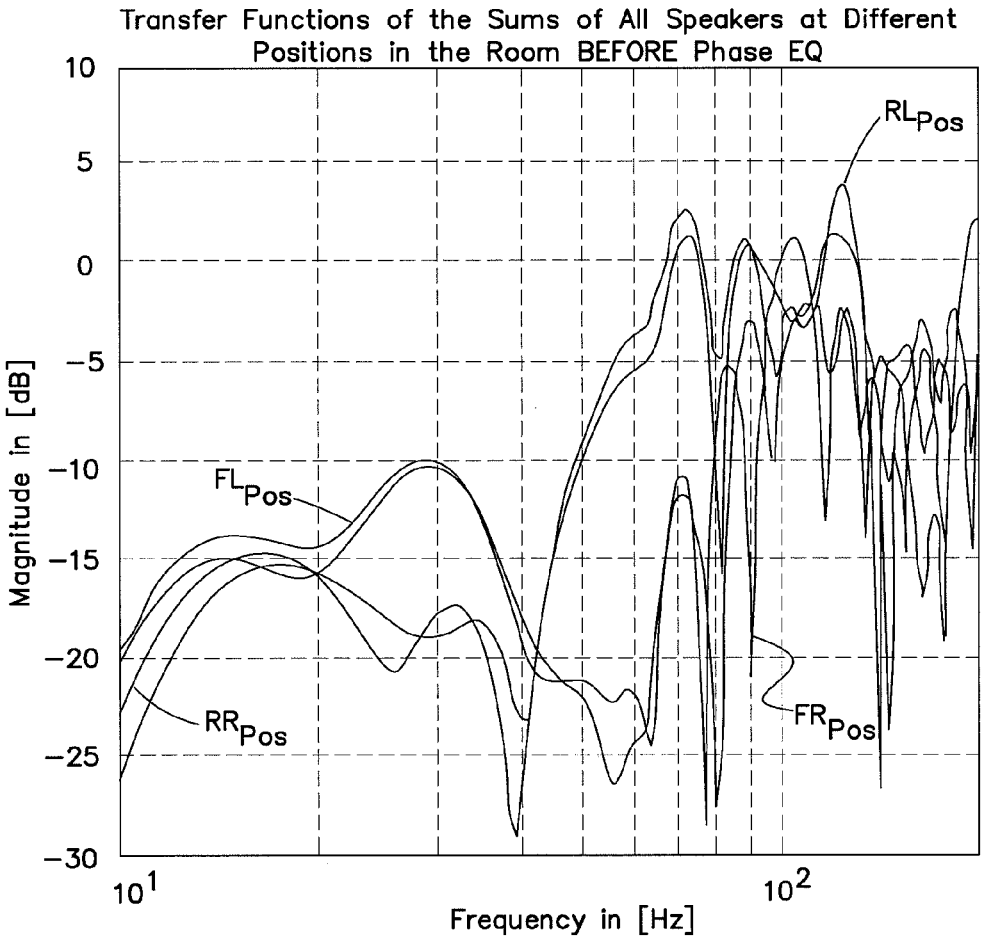
FIG. 10 illustrates the sound pressure levels in the lower frequency range at four listening positions over frequency.

As can be seen from FIG. 10, the sound levels may vary depending on the particular position and frequency.

Figure 11:
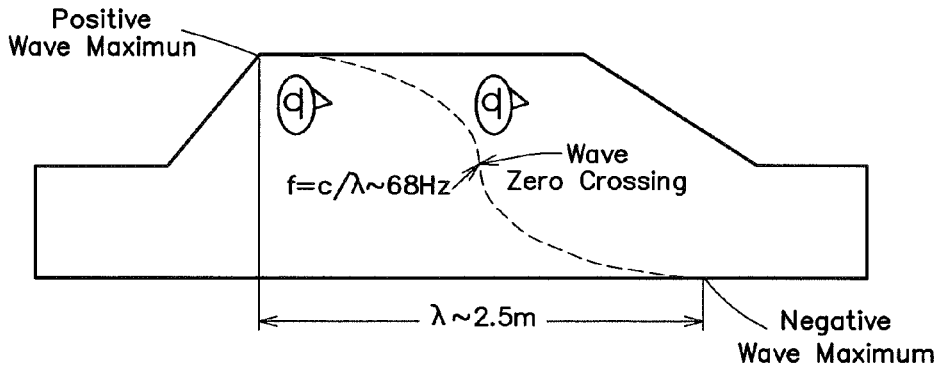
FIG. 11 illustrates the sound pressure distribution of a standing wave in a vehicle interior.

Improvements addressing this situation may be reached by a bass management system. Measurements showed that problems especially with woofers and subwoofers arranged in the rear of a car occur in a frequency range of 40 Hz to 90 Hz, which corresponds to a wave length of one half of the length of a vehicle interior indicating that this is because of a standing wave. In particular, measurements of the unsigned amplitude over frequency showed that the unsigned amplitude at the front seats are different from the ones at the rear seats, i.e., at the rear seats a maximum and at the front seats a minimum may occur. The difference between front and rear seats may be up to 10 dB especially if the subwoofer is arranged in the trunk of a car (see FIG. 11). Although a different position, for example, under the front seats, of the subwoofer may provide some improvement, the bass management system improves the sound even more, not only in view of the front-rear mode but also the left-right mode.

The bass management system creates the same or at least a similar sound pressure at different locations by adapting the phase over frequency for one or more of the low frequency loudspeakers. If this successfully took place, it is no problem to adapt the amplitude over frequency to the target function, since all loudspeakers only have to be weighted with an overall amplitude equalizing function to get amplitude over frequency being equal to the target function at all positions.

However, it is difficult to adapt the phases such that the sound levels at different positions are almost the same. A major problem is to find an appropriate cost function to be minimized subsequently. For example, the level over frequency of one position or the average level over frequency of all positions may be taken as a reference where subsequently the distance of each individual position to the reference is determined. The individual distances are added leading to a first cost function that stands for the overall distance from the reference mentioned above. To reduce/minimize the first cost function, it is investigated what phase shift has what influence to the cost function.

A simple approach is to choose a first group of loudspeakers (which may be only one loudspeaker) or a first channel serving as the reference to which a second group of loudspeakers (which also may be only one loudspeaker) or a second channel is adapted in terms of phase such that the cost function is minimized. Investigating the influence of the phase shift (0° to 360°) of the second channel to the cost function at an individual frequency, a cost function over phase is derived that shows the dependency of the distance from the phase. Determining the minimum of this cost function leads to the phase shift that has to be applied to the respective group or channel to reach a maximum reduction of the cost function and, accordingly, a maximum equalization of the sound levels of all positions.

However, the steps described above may result in an undesired overall reduction of the sound level. To overcome this problem, another condition is introduced which effects not only the same sound level at each position but also the maximum overall sound level possible. This is achieved by taking the reciprocal function of the mean position sound level for scaling the above-mentioned distance where the scaling is adjustable by a weighting function.

Figure 12:
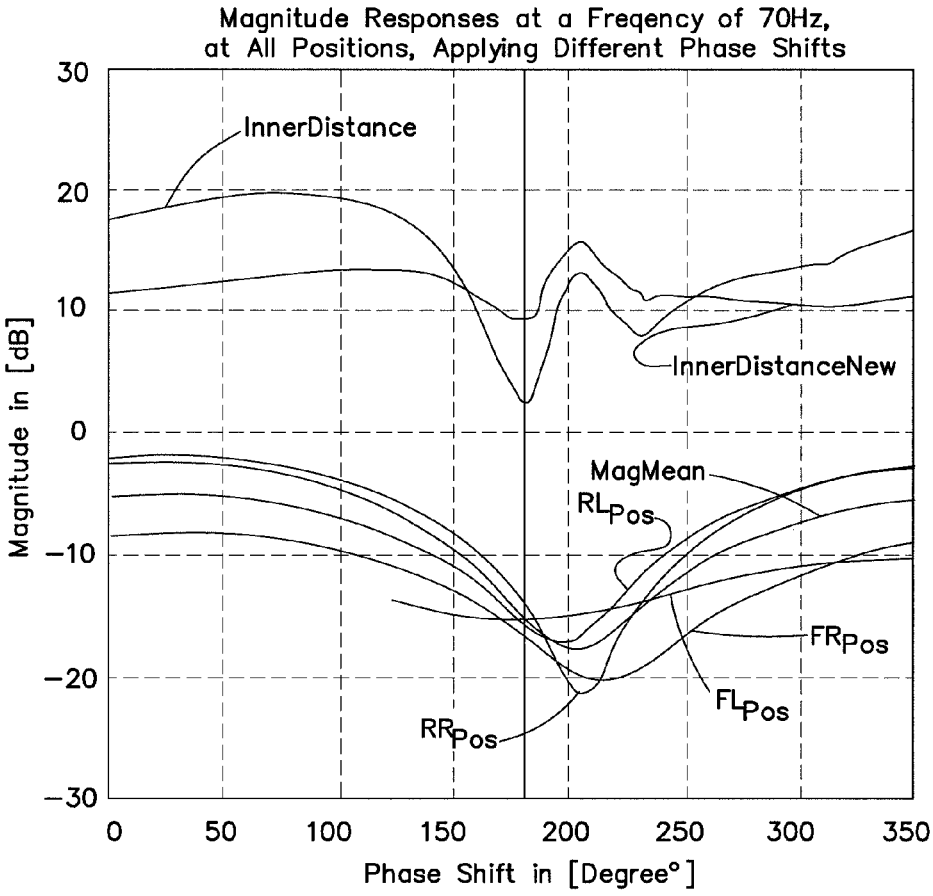
FIG. 12 illustrates phase shift of one channel at certain frequency related to a reference channel.

As shown in FIG. 12, with a 0° phase shift at 70 Hz there is a huge difference between the front positions and the rear positions. Introducing an additional phase shift, the level at each position decreases further, however, the levels are equalized. The behavior of such so-called inner distance, i.e., the cost function for a maximum adaptation of all listening positions, has its minimum at a phase shift of about 180°. The curve depicted as MagMean represents the average level of all positions. Inverting and weighting the MagMean function by, for example, a factor 0.65, and adding the inner distance weighted by a complementary factor 0.35 (=1-0.65) leads to a new inner distance, InnerDistanceNew, which is the cost function to be minimized. FIG. 12 illustrates how the cost function is changed by changing the mean sound pressure level. In the example of FIG. 12 the optimum phase shift is not changed since the original cost function and the modified cost function have their overall minimum at the same position. By the modification described above, beside a good amplitude equalization at all positions and a maximum level also a more even phase equalization can be achieved.

Figure 13:
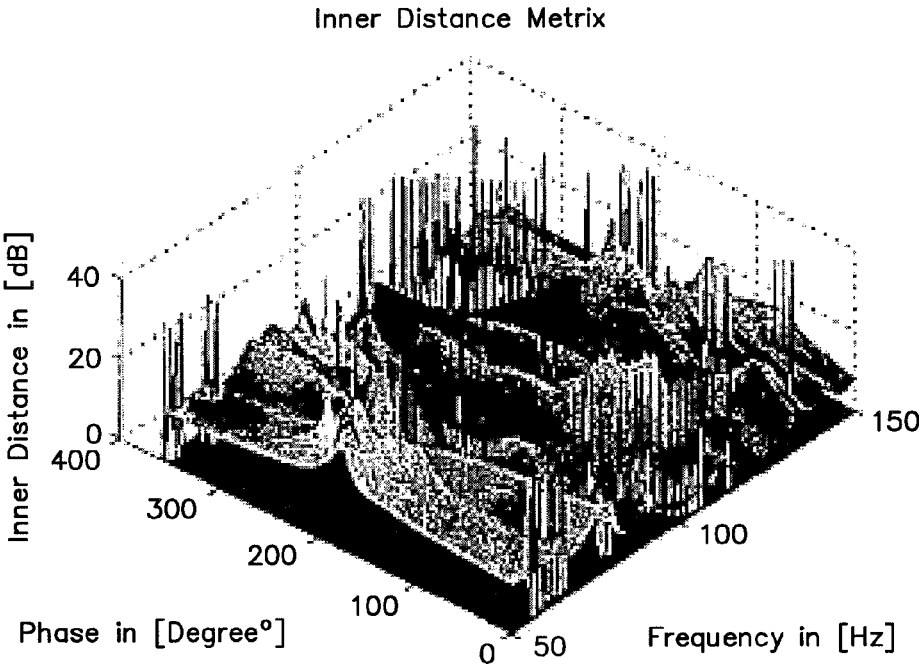
FIG. 13 illustrates a three-dimensional diagram of phase equalization function with no phase limiting.
Figure 14:
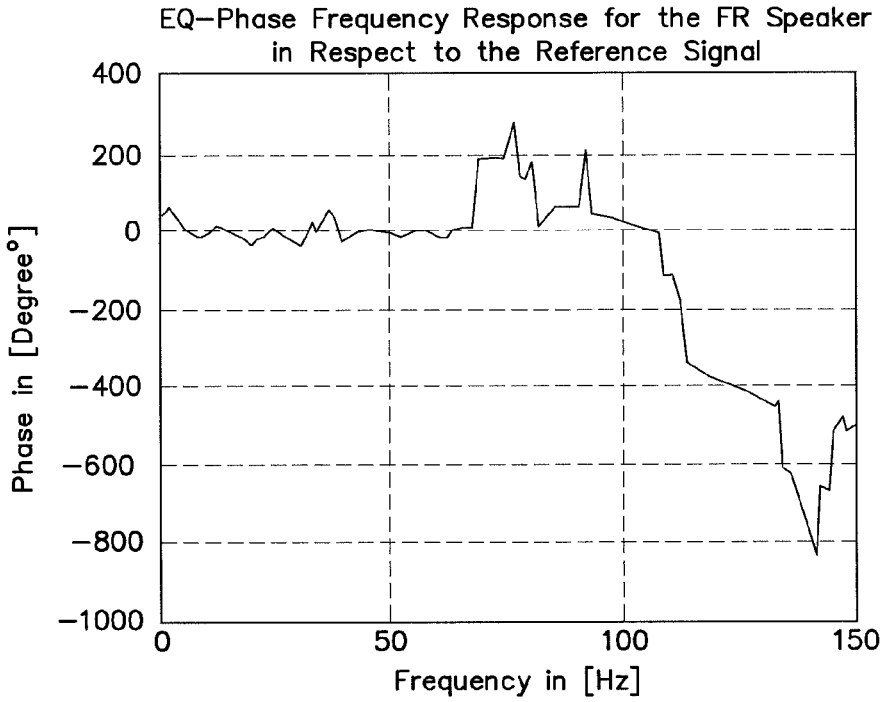
FIG. 14 illustrates an equalization phase frequency response for a certain position with respect to a reference signal in the example of FIG. 13.
Figure 15:
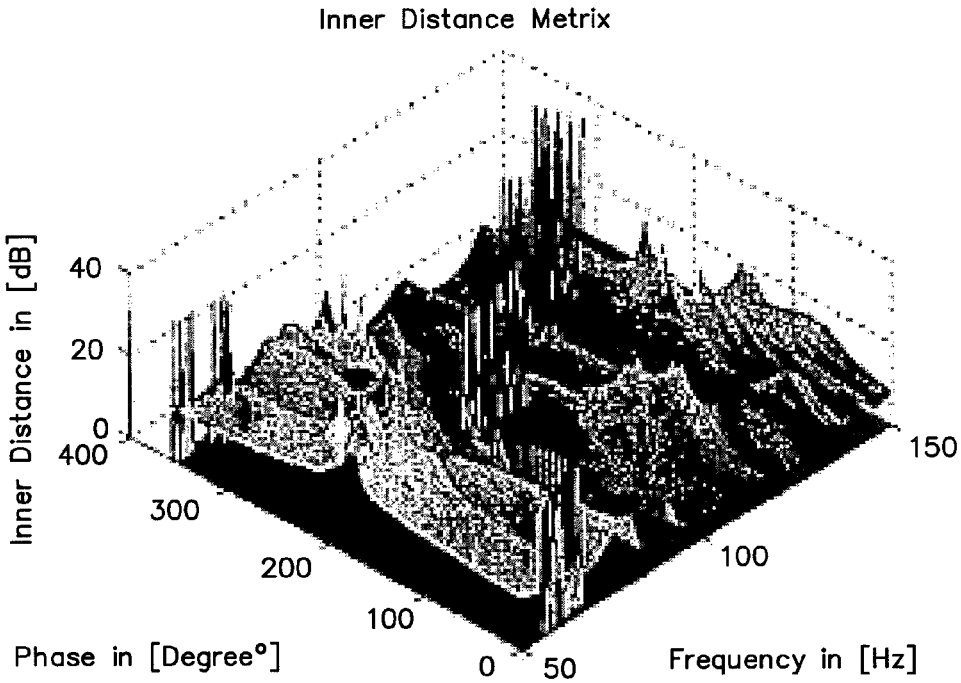
FIG. 15 illustrates a three-dimensional diagram of phase equalization function with phase limiting.

However, the above measures may lead to a very discontinuous phase behavior that requires a very long FIR filter length. The problem behind can better be seen from a three-dimensional illustration like the one shown in FIG. 13 where the cost functions of FIG. 12 are arranged side by side resulting in a "mountain"-like three-dimensional structure representing the cost function of one loudspeaker (or one group of loudspeakers) as inner distance (InnerDistance [db]) over phase [degree] and frequency [Hz]. FIG. 14 illustrates the corresponding equalizing phase-frequency response for the front right loudspeaker with respect to the reference signal.

Figure 16:
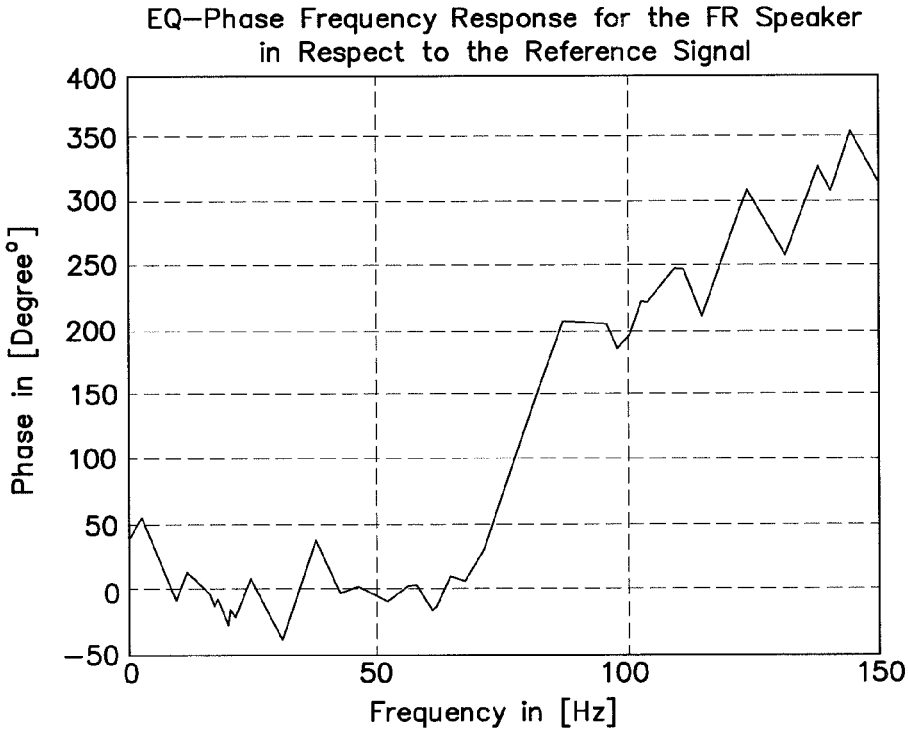
FIG. 16 illustrates the equalization phase frequency response for a certain position with respect to a reference signal in the example of FIG. 15.

To reach an even more straight, more continuous curve in the "mountains", and in particular to achieve a very continuous phase behavior, the phase shift per frequency change (e.g., 1 Hz) may be restricted to a certain maximum phase shift, e.g., ±10°. For each such restricted phase shift range the local minimum is determined for each frequency (e.g., 1 Hz steps) which then is used as a new phase value in the phase equalization process. The results can be seen from the three-dimensional illustration in FIG. 13 where the maximum phase shift per frequency change is restricted to ±10° per frequency step. FIG. 16 illustrates the corresponding equalizing phase-frequency response for the front right loudspeaker with respect to the reference signal.

Figure 17:
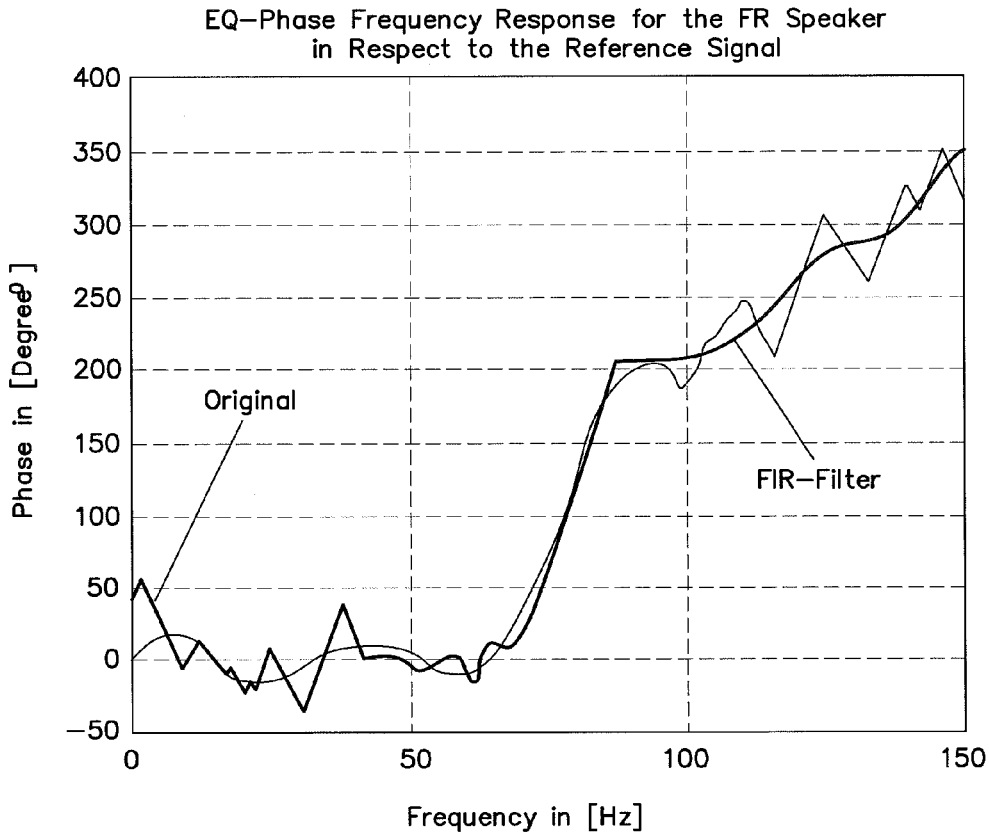
FIG. 17 illustrates a modeled equalizing phase frequency response for a certain position with respect to the reference signal.

As already mentioned, the restriction of the maximum phase shift per frequency change leads to a flat phase response such that already existing FIR filters as, for example, the one used for the other equalizing purposes, are applicable. Such FIR filter may comprise only 4096 taps at a sample frequency of 44.1 kHz. The results are illustrated in FIG. 17. As can be seen, even a short filter shows already a good approximation to the desired behavior (original).

Upon determining the phase equalizing function for an individual loudspeaker, subsequently a new reference signal is derived through superposition of the old reference signal with the new phase equalized loudspeaker group (or channel). The new reference signal serves as a reference for the next loudspeaker to be investigated. Although each group of loudspeakers (or channel) can be used as a reference the front left position may be preferred since most car stereo systems will have a loudspeaker in this particular position.

Figure 18:
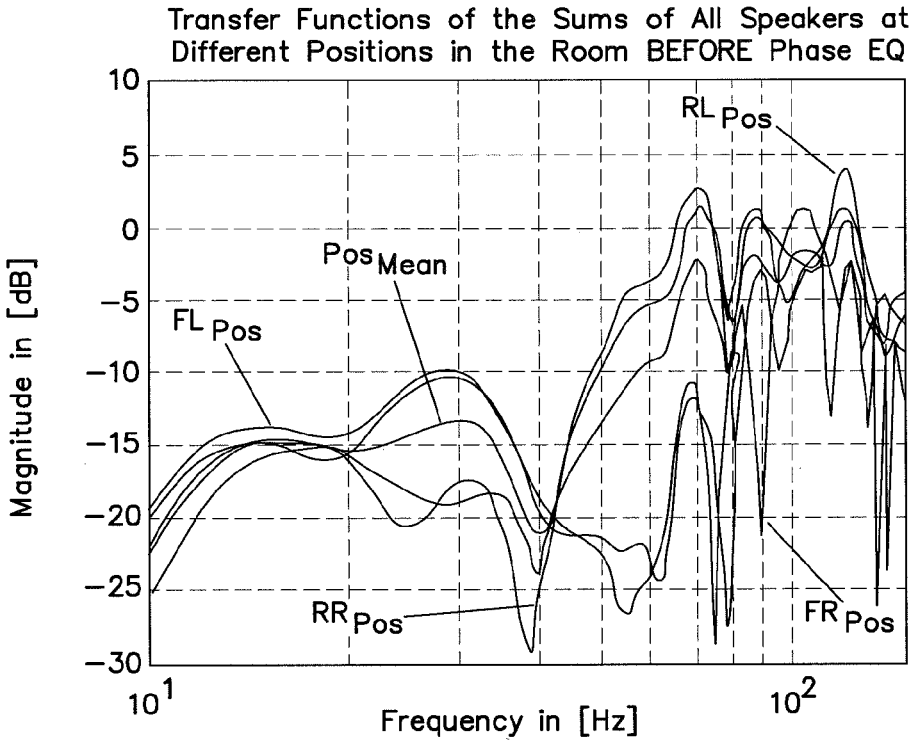
FIG. 18 illustrates the transfer functions of the sums of all speakers at different positions before phase equalization.
Figure 19:
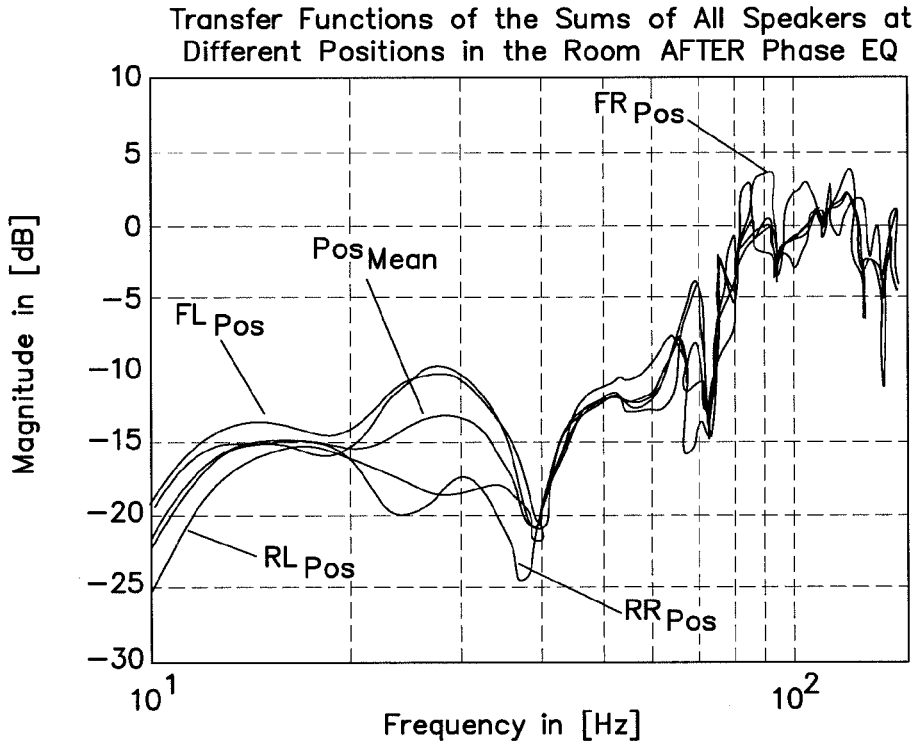
FIG. 19 illustrates the transfer functions of the sums of all speakers at different positions after phase equalization.
Figure 20:
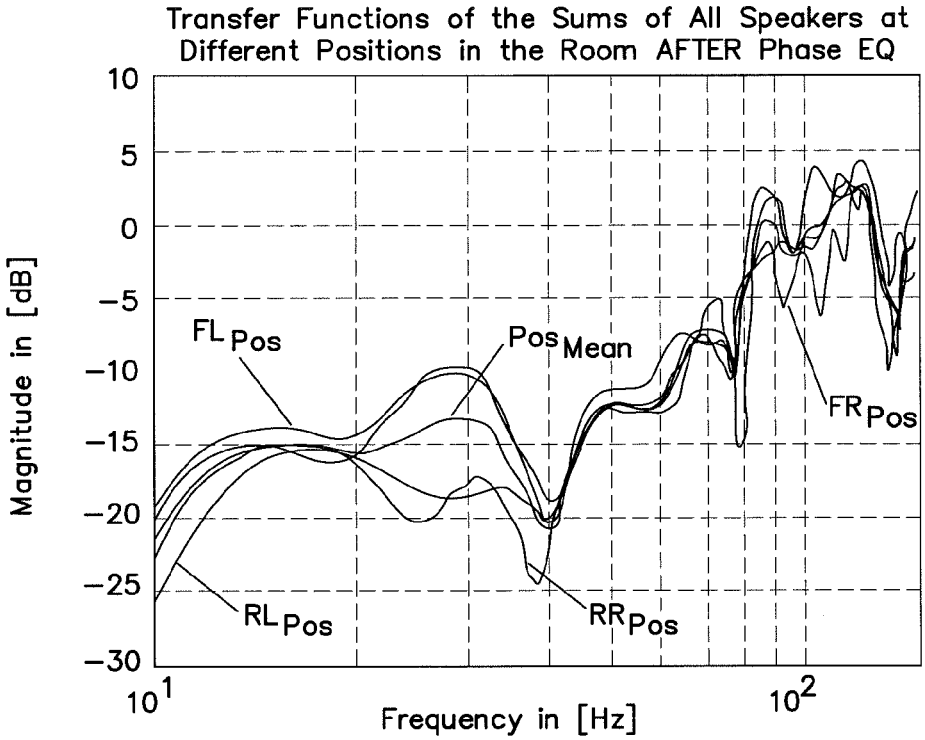
FIG. 20 illustrates the transfer functions of the sums of all speakers at different positions after phase equalization and phase shift limiting.
Figure 21:
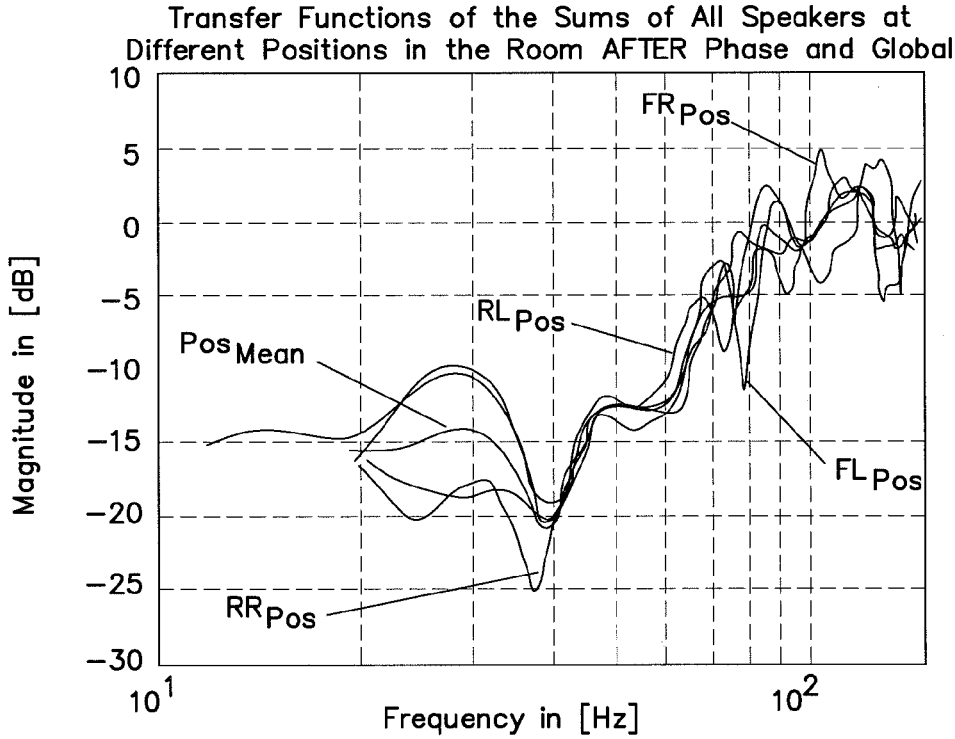
FIG. 21 illustrates the transfer functions of the sums of all speakers at different positions after phase equalization and phase shift limiting.

FIG. 18 illustrates the sound pressure levels over frequency at four positions in the interior of a vehicle with the already mentioned difference between front and rear seats. FIG. 19 shows the sound pressure levels over frequency upon filtering the respective electrical sound signals according to the above mentioned technique using the phase equalizing function with no phase limitation. FIG. 20 illustrates the case of applying such a phase limitation of ±10° per frequency step. FIG. 21 shows the performance of the bass management system as sound pressure level over frequency using a FIR filter with 4096 taps.

Apparently, all kinds of bass management systems discussed above create similar situations for each of the positions with frequencies below 150 Hz with no decrease in the average sound pressure level. Further, only above approximately 100 Hz there is a significant difference between the cases of having a phase limitation or not. Finally, there is no significant difference between the theoretically optimum behavior (FIG. 20) and the behavior of an approximation thereof by a 4096 taps FIR filter (FIG. 21).

Figure 22:
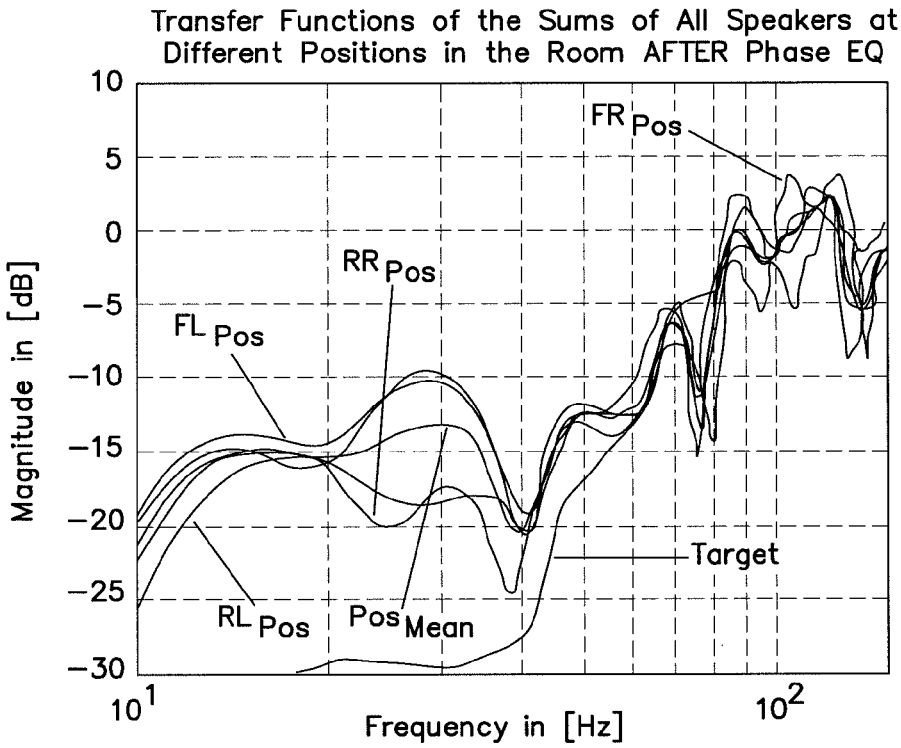
FIG. 22 illustrates the transfer functions of the sums of all speakers at different positions after phase equalization.
Figure 23:
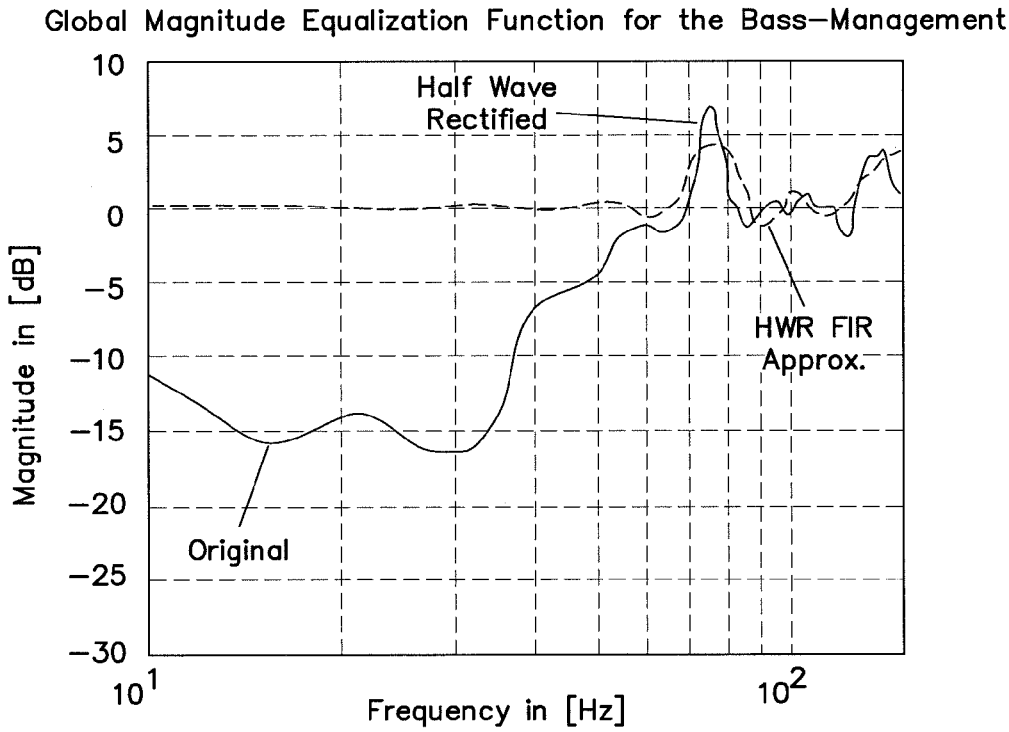
FIG. 23 illustrates the global amplitude equalization function for the bass management.
Figure 24:
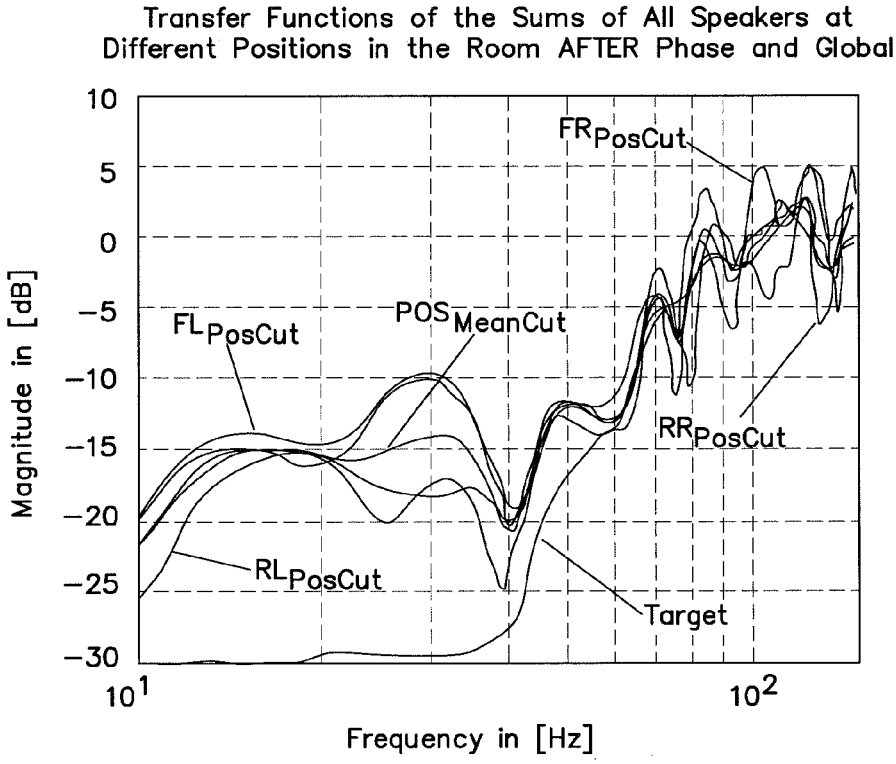
FIG. 24 illustrates the transfer functions of the sums of all speakers at different positions after phase and global amplitude equalization.

Upon such phase equalization filtering, a reference is derived from the average amplitude over frequency of all positions under investigation. The reference is then adapted to a target function by an amplitude equalization function which is the same for all positions to be investigated. The target function may be, for example, the manually modified sum amplitude response of the auto equalization routine that, in turn, follows automatically its respective target function. The resulting target function for the bass management system is depicted "Target" in FIGS. 22 and 23. By subtracting the target function from the average amplitude response of all positions a global equalizer function (FIG. 23: "original") is derived. In order to avoid a decrease in the low frequency range by this measure, the global amplitude equalizing function (FIG. 2: "half wave rectified") is applied to compensate for the decrease. FIG. 24 shows as a result the transfer functions of the sums of all speakers at different positions after phase and global amplitude equalization.

Although FIR filters in general have been used in the examples above, all kind of digital filtering may be used. However, emphasis is put to minimal phase FIR filters which showed the best performance, particularly, in view of the acoustical results as well as the filter length.

Figure 25:
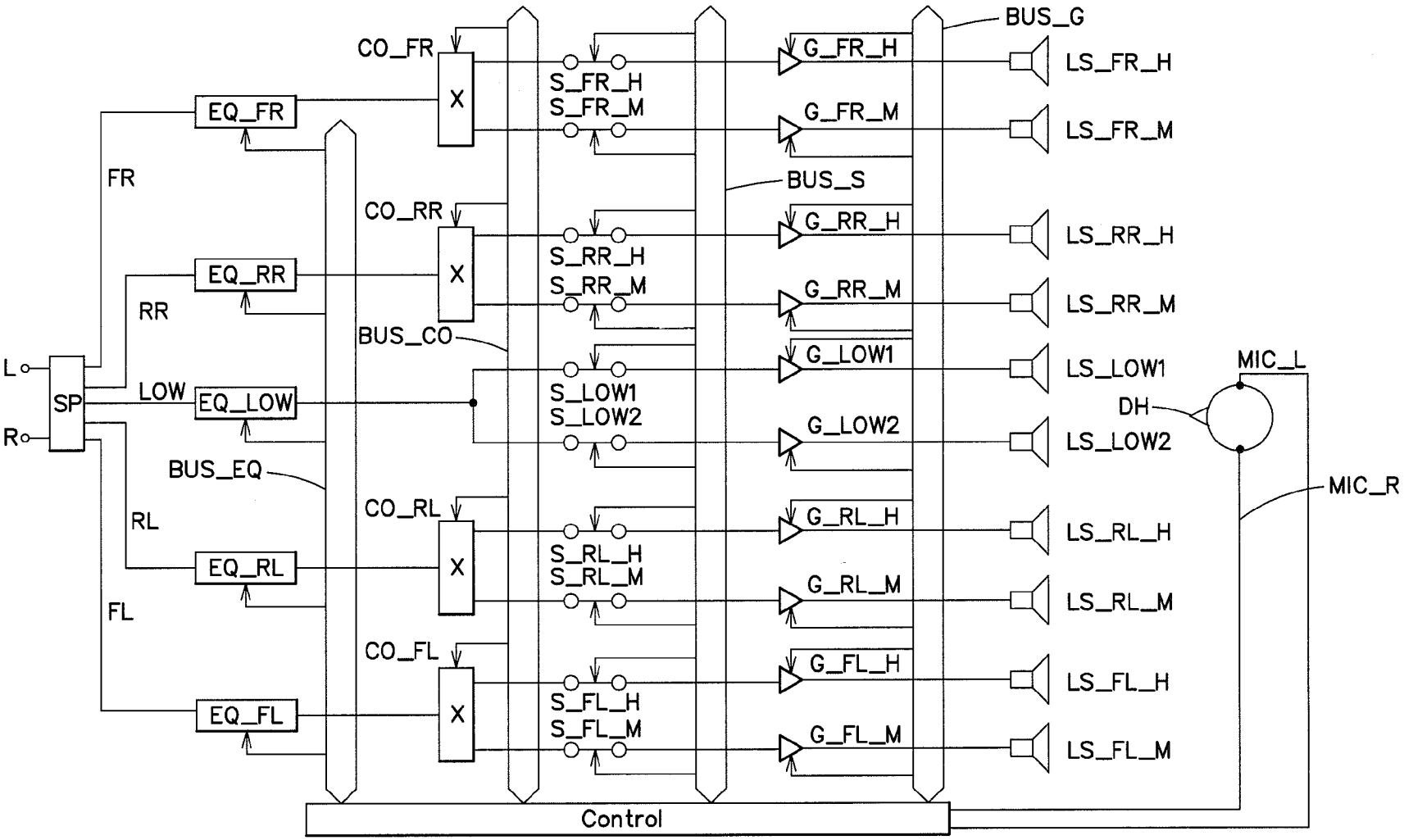
FIG. 25 illustrates signal flow diagram of a sound equalization system.

FIG. 25 illustrates the signal flow in a system exercising the methods described above. In the system of FIG. 25, two stereo signal channels, a left channel L and a right channel R, are supplied to a sound processor unit SP generating five channels thereof. The five channels are a front right channel FR, a rear right channel RR, a rear left RL, a front left channel FL, and a woofer and/or sub-woofer channel LOW. Each of the five channels is supplied to a respective equalizer unit EQ_FR, EQ_RR, EQ_RL, EQ_FL, and EQ_LOW for amplitude and phase equalization. The equalizer units EQ_FR, EQ_RR, EQ_RL, EQ_FL, and EQ_LOW are controlled via a equalizer control bus BUS_EQ by a control unit CONTROL, which also performs the basic sound analysis for controlling other units of the system. The equalizer units EQ_FR, EQ_RR, EQ_RL, EQ_FL, and EQ_LOW comprise preferably minimal phase FIR filters.

Such other units are, for example, controllable crossover filter units CO_FR, CO_RR, CO_RL, and CO_FL having a controllable crossover frequency and being connected downstream of the respective equalizer units EQ_FR, EQ_RR, EQ_RL, and EQ_FL for splitting each respective input signal into two output signals, one in the high frequency range and the other in the mid frequency range. The signals from the crossover filter units CO_FR, CO_RR, CO_RL, and CO_FL are supplied via respective controllable switches S_FR_H, S_RR_H, S_RL_H, S_FL_H, S_FR_M, S_RR_M, S_RL_M, and S_FL_M as well as controllable gain units G_FR_H, G_RR_H, G_RL_H, G_FL_H, G_FR_M, G_RR_M, G_RL_M, and G_FL_M to loudspeakers LS_FR_H, LS_RR_H, LS_RL_H, LS_FL_H, LS_FR_M, LS_RR_M, LS_RL_M, and LS_FL_M. The signal from the equalizer unit EQ_LOW is supplied via two controllable switches S_LOW1 and S_LOW2 as well as respective controllable gain units G_LOW1 and G_LOW2 to (sub-)woofer loudspeakers LS_LOW1 and LS_LOW2. The controllable switches S_FR_H, S_RR_H, S_RL_H, S_FL_H, S_FR_M, S_RR_M, S_RL_M, S_FL_M, S_LOW1, S_LOW2 and the controllable gain units G_FR_H, G_RR_H, G_RL_H, G_FL_H, G_FR_M, G_RR_M, G_RL_M, G_FL_M, G_LOW1, G_LOW2 are controlled by the control unit CONTROL via control bus BUS_S or BUS_G, respectively.

For sound analysis, two microphones MIC_L and MIC_R are arranged in a dummy head DH located in the room where the loudspeakers are located. The signals from the microphones MIC_L and MIC_R are evaluated as described herein further above where, during the analysis procedure, a certain group of loudspeakers (including groups having only one loudspeaker) may be switched on while the other groups are switched off by the controlled switches S_FR_H, S_RR_H, S_RL_H, S_FL_H, S_FR_M, S_RR_M, S_RL_M, S_FL_M, S_LOW1, S_LOW2. The groups may be switched on sequentially according to a given sequence or dependant on the deviation from a target function.

Although various examples to realize the invention have been disclosed, it will be apparent to those skilled in the art that various changes and modifications can be made which will achieve some of the advantages of the invention without departing from the spirit and scope of the invention. It will be obvious to those reasonably skilled in the art that other components performing the same functions may be suitably substituted. Such modifications to the inventive concept are intended to be covered by the appended claims. Although shown in connection with AutoEQ, for example, the adaptation technique method of the crossover frequencies and the bass management method may be each used in a stand alone application or in connection equalizing methods as well.

What is claimed is:

1. A method for adjusting a sound system to a target sound, the sound system having at least two groups of loudspeakers supplied with electrical sound signals to be converted into acoustical sound signals, the method comprising the steps of:

individually supplying each group with the respective electrical sound signal;

individually assessing deviation of the acoustical sound signal from the target sound for each group of loudspeakers in at least one listening position;

adjusting at least two of the groups of loudspeakers to a relatively small deviation from the target sound by equalizing the respective electrical sound signals supplied to the groups of loudspeakers, determining a function representing the average level of all positions;

inverting and weighting the function representing the average level function by a first factor;

adding the inner distance weighted by a second factor being complementary to the first leading to a new inner distance which represents a modified cost function; and reducing the modified cost function, where the assessment step includes receiving in the listening position the acoustical sound signal from a certain group of loudspeakers, where the total assessment over all listening positions is derived from the assessments at the at least one listening position weighted with a location specific factor, and where each location specific factor comprises an amplitude specific factor and a phase specific factor and where the level over frequency of one position or the average level over frequency of all positions is taken as a reference where subsequently the distance of each individual position from the target function is determined.

2. The method of claim 1, where each acoustical sound signal comprises a phase and an amplitude, and the phase and amplitude are processed and equalized independently from each other.

3. The method of claim 1, where at least one group of loudspeakers comprises only one loudspeaker.

4. The method of claim 1, where at least one group of loudspeakers comprises more than one loudspeaker.

5. The method of claim 1, where each loudspeaker is arranged at a respective position and radiates the respective acoustical sound signal in a respective frequency range; at least one loudspeaker differs from the other loudspeaker(s) by the position and/or the frequency range and/or the electrical sound signal channel; and each group of loudspeakers comprises only a loudspeaker or loudspeakers arranged in a certain area and/or having a certain frequency range.

6. The method of claim 5, where at least one group of loudspeakers comprises a loudspeaker or loudspeakers arranged in the front left, front right, rear left, or rear right position.

7. The method of claim 5, where at least one group of loudspeakers comprises a loudspeaker or loudspeakers arranged in a higher or lower position.

8. The method of claim 5, where at least one group of loudspeakers comprises a loudspeaker or loudspeakers radiating the respective acoustical sound signals in a higher frequency range, in a mid-frequency range, a lower frequency range, or a very low frequency range.

9. The method of claim 1, where the step of adjusting a group of loudspeakers to a relatively small deviation from the target sound takes place when the respective group is supplied with the respective electrical sound signal.

10. The method of claim 1, where the step of adjusting the groups of loudspeakers to a relatively small deviation from the target sound takes place after the deviations of all groups have been assessed.

11. The method of claim 1, where the groups of loudspeakers are adjusted sequentially to relatively small deviations from the target sound in a given order.

12. The method of claim 1, where the groups of loudspeakers are adjusted to relatively small deviations from the target sound according to a ranking by the deviations of the groups.

13. The method of claim 12, where the groups of loudspeakers are ranked such that the group having the largest deviation is adjusted first.

14. The method of claim 13, where the deviation is the integral amplitude difference between the assessed acoustical sound signal and the target sound over frequency.

15. The method of claim 13, where the deviation is the maximum amplitude difference between the assessed acoustical sound signal and the target sound over frequency.

16. The method of claim 1, where, after finishing the adjusting steps for at least two groups of loudspeakers, again the following steps are performed:

sequentially supplying each group with the respective electrical sound signal;

sequentially assessing the deviation of the acoustical sound signal from the target sound for each group of loudspeakers; and adjusting at least two groups of loudspeakers to a relatively small deviation from the target sound by equalizing the respective electrical sound signals supplied to the groups of loudspeakers.

17. The method of claim 16, where at least two groups of loudspeakers have adjacent frequency ranges including a common cross over frequency, and the method further comprises adjusting the cross over frequency due to the respective assessments of the deviation of the acoustical sound signal from the target sound for each group of loudspeakers.

18. The method of claim 16, where the method further comprises assessing the deviation of the acoustical sound signal from the target sound for each group of loudspeakers in at least two different listening positions.

19. The method of claim 18, where the deviation of the acoustical sound signal from the target sound for each group of loudspeakers is assessed at the at least two different listening positions.

20. The method of claim 19, where the total assessment over all listening positions is derived from the assessments at the at least two different listening locations weighted with a location specific factor.

21. The method of claim 20, where each location specific factor comprises an amplitude specific factor and a phase specific factor.

22. The method of claim 1, where the step of assessing the deviation of the acoustical sound signal from the target sound for each group of loudspeakers includes picking up a two-channel acoustical signal, converting the acoustical signal into a two-channel electrical sound signal, and calculating the derivations for each channel.

23. The method of claim 1, further comprising the step of pre-equalizing all groups of loudspeakers by limiting the respective electrical sound signals to given amplitude maximums and minimums over frequency before assessing the deviation of the acoustical sound signal from the target sound for each group of loudspeakers.

24. The method of claim 1, where the step of adjusting at least two groups of loudspeakers to a relatively small deviation from the target sound by equalizing the respective electrical sound signals supplied to the groups of loudspeakers includes limiting the amplitude change and/or phase change per frequency caused by the equalizing to a given value.

25. The method of claim 24, where the target function is scaled such that the acoustical sound signal upon limited equalization is able to meet the target function.

26. The method of claim 1, where the acoustical sound signal is picked up for processing the deviation from the target sound by a microphone.

27. The method of claim 1, where the acoustical sound signal is picked up for processing the deviation from the target sound by at least two microphones.

28. The method of claim 27, where the two microphones are arranged in a dummy head.

29. The method of claim 1, where first the phase for one or more of the low frequency loudspeakers is adapted to the target function and then the amplitude is adapted to the target function for all loudspeakers including weighting with an overall amplitude equalizing function for all positions.

30. The method of claim 1, where the individual distances are added leading to a cost function which stands for the overall distance from the reference.

31. The method of claim 30, where, in order to minimize the cost function, it is investigated what phase shift has what influence to the cost function.

32. The method of claim 1, where the phase shift per frequency change is restricted to a certain maximum phase shift, and for each such restricted phase shift range the local minimum is determined for each frequency which then serves as a new phase value in a phase equalization process.

33. The method of claim 1, further comprising the steps of:

determining the phase equalizing function for an individual loudspeaker, subsequently deriving a new reference signal through superposition of the old reference signal with the new phase equalized loudspeaker group.

34. The method of claim 33, where the new reference signal serves as a reference for the next loudspeaker to be investigated.

35. The method of claim 33, further comprising:

deriving a reference from the average amplitude over frequency of positions under investigation; and adapting the reference to a target function by an amplitude equalization function.

36. The method of claim 35, where the target function is the same for all positions to be investigated.

37. The method of claim 36, where the target function is the modified sum amplitude response of the auto equalization algorithm that follows automatically its respective target function.

38. The method of claim 37, further comprising subtracting the target function from the average amplitude response of all positions in order to derive a global equalizer function.

39. The method of claim 38, where the global amplitude equalizing function is applied to all groups.

40. The method of claim 1, the phase and/or amplitude equalizing is performed by minimal phase FIR filtering.

* * * * *